US012123610B2

(12) United States Patent
Buda

(10) Patent No.: US 12,123,610 B2
(45) **Date of Patent: *Oct. 22, 2024**

(54) CONTINUOUS LEARNING COMPRESSOR INPUT POWER PREDICTOR

(71) Applicant: Schneider Electric USA, Inc., Andover, MA (US)

(72) Inventor: Paul R. Buda, Raleigh, NC (US)

(73) Assignee: Schneider Electric USA, Inc., Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/387,819

(22) Filed: Nov. 7, 2023

(65) Prior Publication Data

US 2024/0068688 A1 Feb. 29, 2024

Related U.S. Application Data

(63) Continuation of application No. 17/463,476, filed on Aug. 31, 2021, now Pat. No. 11,808,468.

(51) Int. Cl.
*F24F 11/49* (2018.01)
*F24F 11/38* (2018.01)

(52) U.S. Cl.
CPC ..... *F24F 11/49* (2018.01); *F24F 11/38* (2018.01)

(58) Field of Classification Search
CPC ..... F24F 11/49; F24F 11/38; F24F 2140/20; F24F 11/32; F25B 2500/19;
(Continued)

(56) References Cited

U.S. PATENT DOCUMENTS

2009/0071175 A1* 3/2009 Pham ..... F25B 49/02 62/149
2011/0144807 A1* 6/2011 Buda ..... F25B 49/005 700/275

(Continued)

FOREIGN PATENT DOCUMENTS

CN 102353403 A 2/2012

OTHER PUBLICATIONS

Extended European Search Report for EP Application No. 22187628.7 dated May 22, 2023.

*Primary Examiner* — Santosh R Poudel
(74) *Attorney, Agent, or Firm* — Locke Lord LLP

(57) ABSTRACT

System and method for monitoring and detecting potential problems early in a VCC based HVAC&R system employs a monitoring application or agent that uses continuous machine learning and a temperature map to derive or "learn" a relation between a measured input power parameter of one or more system compressors, and condenser and evaporator intake fluid temperatures, based on observations of the temperatures and the input power parameter when the HVAC&R system is new or in a "newly maintained" condition. The monitoring agent can then use the learned relation to determine, based on subsequent observations of the condenser and evaporator intake fluid temperatures, the input power parameter values that should be expected if the HVAC&R system were operating in the "newly maintained" condition. The agent can thereafter compare the expected compressor input power parameter values with observed input power parameter values to determine early whether the system is experiencing performance degradation.

20 Claims, 14 Drawing Sheets

(58) Field of Classification Search
CPC .. F25B 2700/21161; F25B 2700/21171; F25B 49/005; F25B 49/025; F25B 2600/024; F25B 2700/151; F25B 49/02
See application file for complete search history.

(56) References Cited

U.S. PATENT DOCUMENTS

| | | | | |
|---|---|---|---|---|
| 2013/0319026 | A1* | 12/2013 | Tsuji | F25B 49/02 62/216 |
| 2017/0213102 | A1 | 7/2017 | Morovic | |
| 2017/0241657 | A1 | 8/2017 | Salisbury et al. | |
| 2017/0241689 | A1* | 8/2017 | Brostrom | F04C 18/0215 |
| 2019/0257568 | A1 | 8/2019 | Buda | |
| 2019/0258237 | A1* | 8/2019 | Buda | F24F 11/49 |
| 2020/0240693 | A1* | 7/2020 | Khalili | F25B 7/00 |
| 2021/0063045 | A1 | 3/2021 | Liu | |

* cited by examiner

CONTINUOUS LEARNING COMPRESSOR INPUT POWER PREDICTOR

CROSS-REFERENCE TO RELATED APPLICATIONS

This application for patent is a continuation of U.S. Non-Provisional application Ser. No. 17/463,476, entitled "Continuous Learning Compressor Input Power Predictor," filed Aug. 31, 2021, the disclosure of which is incorporated herein by reference.

TECHNICAL FIELD

The disclosed embodiments relate generally to heating, ventilating, and air conditioning and refrigeration (HVAC&R) systems and, more particularly, to systems and methods of using a Compressor Input Power Predictor (CIPP) relation to detect potential problems early in such HVAC&R systems.

BACKGROUND

HVAC&R systems, which may include residential and commercial heat pumps, air conditioning, and refrigeration systems, employ a vapor-compression cycle (VCC) to transfer heat between a low temperature fluid and a high temperature fluid. In many VCC based systems referred to as direct-exchange systems, the "fluid" is the air in a conditioned space or an external ambient environment. In other VCC based systems, including indirect-exchange systems such as chillers, geothermal heat pumps and the like, the fluid to and from which heat is exchanged may be a liquid such as water or an anti-freeze.

VCC based systems are generally known in the art and employ a refrigerant as a medium to facilitate heat transfer. The systems are mechanically "closed" in that the refrigerant is contained within the mechanical confines of the system and there is a mechanical buffer where the heat is to be exchanged between the refrigerant and the external fluid(s). In these systems, the refrigerant circulates within the system, passing through a compressor, a condenser, and an evaporator. At the evaporator, heat is absorbed by the refrigerant from the space to be cooled in the case of an air conditioner or refrigerator, and absorbed from the external ambient or other heat source in the case of a heat pump. At the condenser, heat is rejected to the external ambient in the case of an air conditioner or refrigerator, or to the space to be conditioned in the case of a heat pump.

Existing VCC based systems, however, do not have sufficient ability to monitor and detect potential problems and performance degradations early. The lack of early problem detection is due in part to the inability of existing VCC based systems to do so quickly and reliably. Typically, detection of performance degradations in VCC based systems required acquiring and processing an enormous amount of data over an extended period of time in order to provide a sufficient level of reliability. The large amount of data and processing required has proven over the years to be overly complex and hence impractical to implement for most VCC based systems.

A need therefore exists for a way to monitor and detect potential problems and performance degradations early in VCC based systems in an efficient manner while also providing a sufficient level of reliability and accuracy.

SUMMARY

The embodiments disclosed herein relate to improved systems and methods for monitoring and detecting potential problems early in a VCC based HVAC&R system. One embodiment described herein provides an improved HVAC&R monitoring system and method that employs a monitoring application or agent that uses continuous machine learning and a temperature map to derive or "learn" a relation between a measured input power parameter of one or more system compressors, and condenser and evaporator intake fluid temperatures, based on observations of the temperatures and the input power parameter when the HVAC&R system is new or in a "newly maintained" condition. The monitoring agent can then use the learned relation to determine, based on subsequent observations of the condenser and evaporator intake fluid temperatures, the input power parameter values that should be expected if the HVAC&R system were operating in the "newly maintained" condition. The agent can thereafter compare the expected compressor input power parameter values with observed input power parameter values to determine early whether the system is experiencing performance degradation. Unlike a conventional machine learning system that requires large data sets acquired over a long period of time to learn the relation between the measured input power parameter and the condenser and evaporator intake fluid temperatures, the embodiments herein can begin to predict power parameter values almost immediately and can continue to learn the "newly maintained" characteristics of the system even while system performance is degrading. Furthermore, embodiments herein can refrain from making predictions under certain conditions where the agent determines the predictions may not be reliable, thereby limiting false positive and false negative detections in the process. The result is an HVAC&R monitoring system and method that is tailored to an individual system, requires minimal commissioning to begin learning, can begin to assess the condition of a system almost immediately while learning the characteristics of the system over a longer period of time, and can make accurate assessment of degradation with few errors.

In general, in one aspect, the disclosed embodiments are directed to a monitoring and early problem detection system for an HVAC&R system. The system comprises, among other things, a data acquisition processor operable to acquire observations about the HVAC&R system, the observations including fluid temperature measurements for a condenser and fluid temperature measurements for an evaporator, the observations further including compressor input power parameter measurements corresponding to the fluid temperature measurements. The system also comprises a compressor input power parameter processor operable to learn a relation between the fluid temperature measurements and the compressor input power parameter measurements, the compressor input power parameter processor configured to compute a predicted value for a compressor input power parameter using the relation. The system further comprises a degradation detection processor operable to compare the predicted value for the compressor input power parameter against an acquired compressor input power parameter measurement.

In general, in another aspect, the disclosed embodiments are directed to a method of monitoring and detecting problems early in an HVAC&R system. The method comprises, among other things, acquiring, by a data acquisition processor, observations about the HVAC&R system, the observations including fluid temperature measurements for a condenser and fluid temperature measurements for an evaporator, the observations further including compressor input power parameter measurements corresponding to the fluid temperature measurements. The method also comprises learning, by a compressor input power parameter processor, a relation between the fluid temperature measurements and the compressor input power parameter measurements, and computing, by the compressor input power parameter processor, a predicted value for a compressor input power parameter using the relation. The method further comprises comparing, by a degradation detection processor, the predicted value for the compressor input power parameter against an acquired compressor input power parameter measurement to determine whether performance degradation has occurred in the HVAC&R system.

In general, in another aspect, the disclosed embodiments are directed to a monitoring and early problem detection system. The system comprises, among other things, a data acquisition processor operable to acquire observations about the system, the observations including measurements for one or more index parameters of the system and measurements for a parameter of interest for the system corresponding to the one or more index parameters. The system also comprises a parameter prediction processor operable to learn a relation between the measurements for the one or more index parameters and the measurements for the parameter of interest, the parameter prediction processor configured to compute a predicted value for the parameter of interest using the relation. The system further comprises a degradation detection processor operable to compare the predicted value for the parameter of interest against an acquired measurement for the parameter of interest and determine based on the comparison whether performance degradation has occurred in the system. In response to performance degradation being detected in the system, the parameter prediction processor is further operable to adjust the measurements for the parameter of interest to compensate for the performance degradation.

In general, in another aspect, the disclosed embodiments are directed to a method of monitoring and early problem detection. The method comprises, among other things, acquiring, by a data acquisition processor, observations about the method, the observations including measurements for one or more index parameters of the method and measurements for a parameter of interest for the method corresponding to the one or more index parameters. The method also comprises learning, by a parameter prediction processor, a relation between the measurements for the one or more index parameters and the measurements for the parameter of interest, and computing, by the parameter prediction processor, a predicted value for the parameter of interest using the relation. The method further comprises comparing, by a degradation detection processor, the predicted value for the parameter of interest against an acquired measurement for the parameter of interest, and determining, by degradation detection processor, based on the comparison, whether performance degradation has occurred in the method. The method still further comprises adjusting, by the parameter prediction processor, the measurements for the parameter of interest to compensate for the performance degradation in response to performance degradation being detected in the system.

In general, in yet another aspect, the disclosed embodiments are directed to a non-transitory computer-readable medium containing program logic that, when executed by operation of one or more computer processors, causes the one or more processors to perform a method according to any of the embodiments described herein.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

Figure 1:
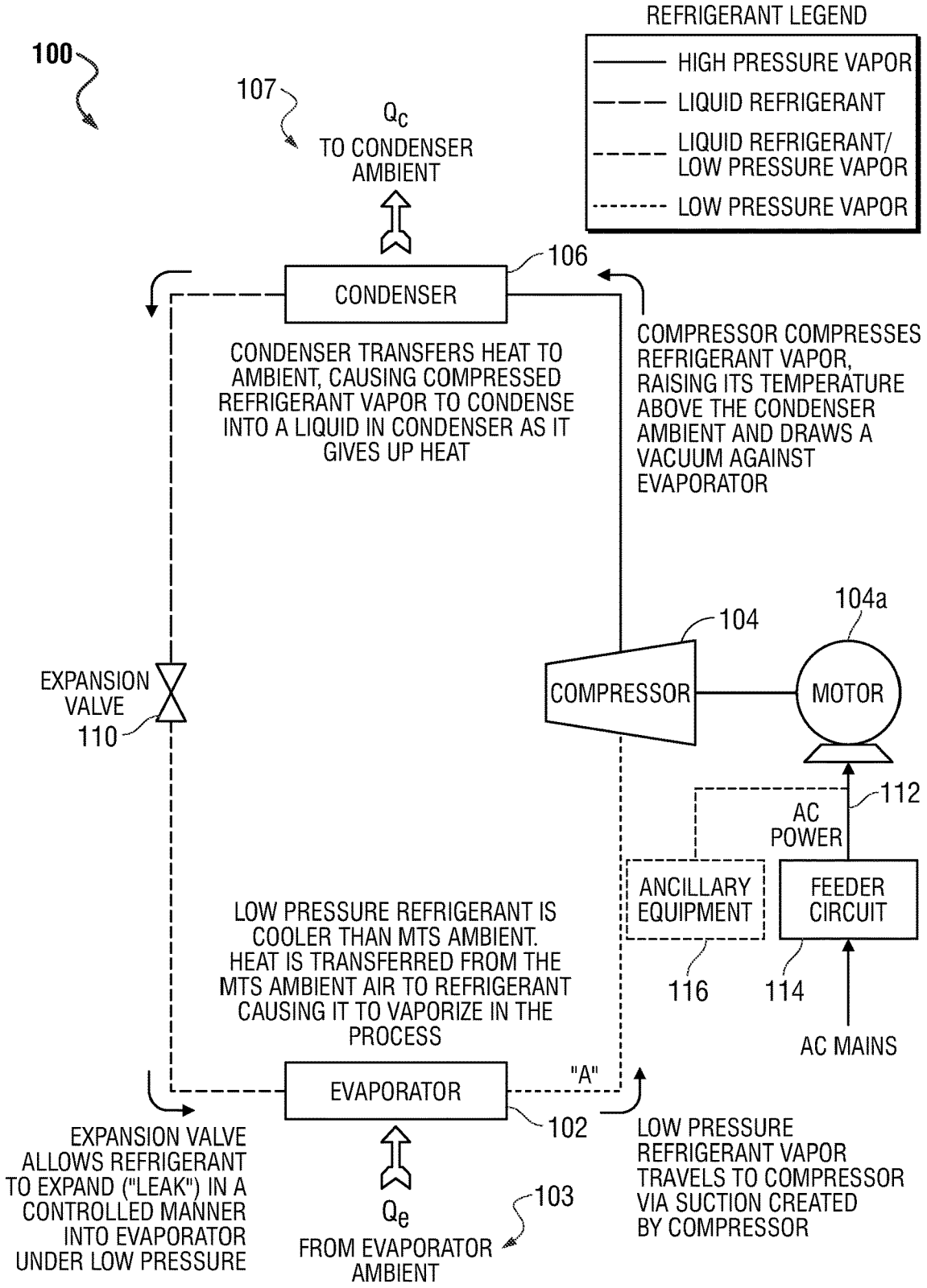
FIG. 1 (Prior Art)
FIG. 1 illustrates a known HVAC&R system employing a vapor compression cycle (VCC)

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Various embodiments disclosed herein relate to systems and methods for monitoring and detecting potential problems early in a VCC based HVAC&R system. As mentioned above, the HVAC&R monitoring systems and methods employ a monitoring application or agent that uses continuous machine learning and a temperature map to learn a relation between a measured input power parameter of one or more system compressors, and condenser and evaporator intake fluid temperatures. The relation is learned based on observations (i.e., measurements) of the intake fluid temperatures and the compressor input power parameter when the HVAC&R system is new or in a "newly maintained" condition. The monitoring agent can then use the learned relation to predict, based on subsequent observations of the HVAC&R system, the expected compressor input power parameter values representing the HVAC&R system in the "newly maintained" condition. The agent can thereafter compare the predicted compressor input power parameter values with observed compressor input power parameter values to detect performance degradation early.

The ability of the disclosed systems and methods to detect problems early arises from certain intuition by the present inventor based on observations that given a set of measurable external conditions of temperature, evaporator and condenser fan speeds, and a known combination of compressor state (i.e., which compressors are on and off at the time in a multi-compressor system), the power consumed by a refrigerant compressor employed in a vapor compression cycle is time invariant and repeatable in steady state so long as the physical condition of the system does not change. More specifically, once the HVAC&R system has run long enough that the internal refrigerant states have stabilized, there is and should be a knowable relation between compressor power parameters, such as real power, current, volt-amperes, and the like, and certain observed temperatures, assuming other aspects of the system remain constant. This time-invariant, learned relation between a compressor input power parameter and condenser and evaporator intake temperatures representing the behavior of the HVAC&R system when in newly maintained condition is referred to as a Compressor Input Power Predictor (CIPP) relation, or simply "relation" herein, and can be employed to detect system degradation in a number of diverse applications, such as air conditioners, heat pumps, refrigerators and other related systems.

Referring now to FIG. 1, a flow diagram for a basic HVAC&R system 100 is shown employing a vapor compression cycle. The CIPP relation mentioned above can be illustrated by examining the VCC based system 100 in FIG. 1. This system 100 represents most of the HVAC&R systems deployed today, so the discussion herein largely focuses on monitoring and detecting problems early in this system. Those having ordinary skill in the art will appreciate that the principles and teachings herein are equally applicable to other types of HVAC&R systems and equipment available to commercial and industrial users. Indeed, the principles and teachings discussed are generally applicable to any deterministic system or equipment in which one parametric outcome or value will reliably result for a given parameter of interest, and thus can be rapidly learned and predicted using the techniques described herein, given another parameter or set of parameters (and the values thereof). Such deterministic systems and equipment are numerous and varied and involve many types of parameters, for example, flow control parameters (e.g., flow rate, viscosity, etc.), power control parameters (e.g., voltage, current, etc.), motion control parameters (e.g., speed, height, etc.) and the like.

Operation of the HVAC&R system 100 is well known in the art and will be described only generally here. Beginning at point "A" in the figure, refrigerant in the form of low-pressure vapor is drawn via suction from an evaporator 102, which is essentially a heat exchanger that absorbs heat from a fluid (i.e., air) at the evaporator ambient 103 and transfers it to the refrigerant flowing within the evaporator to a compressor 104. The compressor 104 receives the low-pressure vapor, compresses it into a high-pressure vapor, and sends it toward a condenser 106, raising the temperature of the refrigerant to a temperature higher than that of the fluid (i.e., air in the case of a direct exchange system for example) of the condenser ambient 107 in the process.

At that condenser 106, condenser coils (not expressly shown) allow the heat in the higher temperature vapor refrigerant to transfer to the lower temperature condenser ambient fluid, as indicated by arrow $Q_c$. This heat transfer causes the high-pressure vapor refrigerant in the condenser coils to condense into a liquid. From the condenser 106, the liquid refrigerant (still under high pressure) enters an expansion valve 110 that atomizes the refrigerant and releases (i.e., sprays) it as an aerosol into the evaporator 102. The temperature of the liquid refrigerant drops significantly as it moves from the inlet side of the expansion valve 110 where it is under high pressure to the outlet side of the expansion valve 110 where it is under relatively low pressure.

At the evaporator 102, the reduced temperature refrigerant cools the evaporator coils (not expressly shown) to well below the temperature of the evaporator ambient fluid in a normally operating system, absorbing heat in the process and causing the refrigerant to evaporate into a vapor. Heat from the evaporator ambient fluid flows is subsequently absorbed by the evaporator coils (not expressly shown) in the process, as indicated by arrow $Q_e$. The low-pressure vapor in the evaporator is then pulled via suction into the compressor 104 at A, and the cycle repeats.

In FIG. 1, the compressor 104 is driven by a compressor motor 104*a*, the power for which is provided by an AC power source, such as a mains AC power line 112. The mains AC power line 112 provides power from an AC mains that is typically fed through a branch feeder circuit 114. The branch feeder circuit 114 serves to isolate and provide short circuit and overcurrent protection for the HVAC&R system 100. Many branch feeder circuits have current or power measurement capability either built in to their circuit breakers or otherwise embedded that can provide a signal indicative of the input power being used by the loads. Examples include the NQ and NF series of panelboards with integrated energy meters from Schneider Electric USA, Inc. In some installations, the HVAC&R system 100 may also include ancillary equipment (shown in dashed lines), such as fans and other ancillary electrical loads, electrical disconnect boxes, and the like, generally indicated at 116, which also receive power from the feeder circuit 114. The ancillary equipment 116 are often found inside a physical housing also housing the compressors of the system 100 and may be in series or parallel with the motor 104*a*.

As will be explained in the following description, one way to detect system degradation is by monitoring the input power actually consumed by the compressor motor 104*a* over the feeder circuit 114 and AC power line 112 and comparing that compressor input power to the compressor input power predicted by the CIPP relation mentioned above. In general, if the comparison indicates the observed compressor input power is different from (i.e., greater or less than) the compressor input power predicted by the CIPP relation by more than a predefined threshold amount (e.g., 5%, 10%, 15%, etc.), then that may be an indication of degraded performance.

The terms "evaporator ambient" and "condenser ambient" as used herein refer to the ambient environment surrounding the evaporator and condenser functions, respectively. When the system 100 is operating in air conditioning mode or as a refrigerator, the evaporator ambient is the space to be cooled or "air conditioned" and is normally a building or room, but may also be the internal space or food storage area of a refrigerator or freezer. In this mode, the condenser ambient is usually the outdoor environment in the case of an air conditioner and some refrigeration systems and may be the room ambient external to the equipment in the case of refrigeration. In other words, a direct exchange air conditioner or refrigerator absorbs heat from the air of a conditioned space and rejects the heat to the outdoor or external environment. When the system 100 is operating as a heat pump in heating mode, the roles of the physical condenser 106 and physical evaporator 104 are reversed so that the physical condenser 106 functions to absorb heat from the nominally cooler outdoor environment and the physical evaporator 102 functions to deliver heat to the building or room being heated.

The HVAC&R system 100 of FIG. 1 is considered to be a "direct exchange" system in which heat is transferred directly to and from the air of the evaporator and condenser ambient environment by the evaporator 102 and condenser 106. However, the embodiments disclosed herein are also applicable to non-direct exchange systems, including "indirect exchange" systems, such as a chiller operating as an air conditioner, or a geothermal heat pump. In a chiller, the evaporator cools a fluid, such as cooling water, that is then transported throughout a building to independently cool the spaces therein through heat exchangers located remotely from the chiller. In some systems, heat is rejected from the condenser into a liquid fluid such as water or an anti-freeze solution, which is then transferred to a cooler ambient, via for instance a cooling tower. Thus, the disclosed embodiments may be used with systems that transfer heat directly to and from the air of the intended spaces as in a conventional direct exchange system, or indirect exchange systems that transfer heat to or from a liquid fluid, such as water, which is then used to cool or heat the intended spaces.

In the description that follows, the term "fluid temperature," when used to describe the intake or exhaust temperature of an evaporator or condenser (or the function thereof), will be understood to be air in the case of a direct exchange system and a liquid or fluid in the case of indirect exchange systems such as chillers. Mixed mode systems, such as a geothermal heat pump that uses water or anti-freeze to exchange heat with the ground and air to exchange heat inside the building, are also within the scope of the disclosed embodiments.

Figure 2:
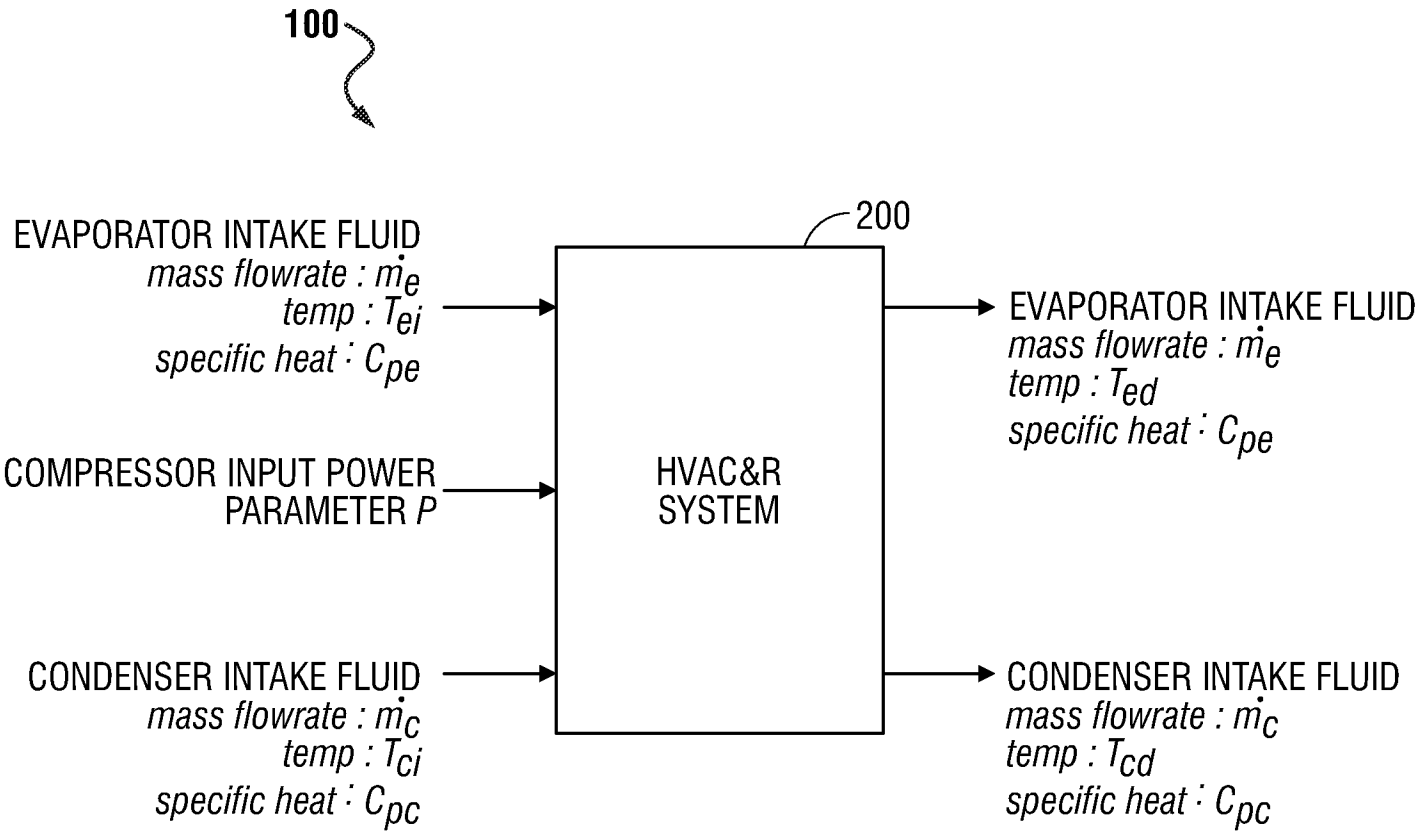
FIG. 2 illustrates a simplified view of the exemplary HVAC&R system as a "black box" according to aspects of the disclosed embodiments.

FIG. 2 shows a simplified view of the HVAC&R system 100 in the form of a so-called "black box" 200 having certain inputs and outputs. Treating the HVAC&R system 100 in this way allows the system to be analyzed in terms of its inputs and outputs (i.e., its transfer characteristics). The inputs to the system 100 when treated as a black box 200 include the condenser intake fluid, which has a specific heat $C_{pc}$, with a mass flow rate $\dot{m}_c$, and operating at a temperature $T_{ci}$, the evaporator intake fluid, which has a specific heat $C_{pe}$, with a mass flow rate $\dot{m}_e$, and operating at a temperature $T_{ei}$, and the compressor input power P. The outputs from the black box 200 include the condenser discharge fluid, which has a specific heat $C_{pc}$, with a mass flow rate $\dot{m}_c$, and operating at a temperature $T_{cd}$, and the evaporator discharge fluid, which has a specific heat $C_{pe}$, with a mass flow rate $\dot{m}_e$, and operating at a temperature $T_{ed}$.

As an additional simplification, it can be assumed that the specific heat of the fluids moving across the condenser and evaporator, $C_{pc}$ and $C_{pe}$, respectively, do not change over time. This generally holds true for a first order approximation. Further, the mass flow rate across the condenser and evaporator, $\dot{m}_c$ and $\dot{m}_e$, are constant for the system 100 operating in steady state. This is the case in the simplest systems in which one or more single speed fans are employed in normal operation to move fluid past the condenser and evaporator assemblies (single speed fans run continuously and do not cycle on and off with temperature or pressure to maintain head pressure).

That the condenser intake and discharge fluids have the same specific heat and mass flow rate derive from the fact that: 1) they are the identical fluids, and 2) the physical system viewed in this way has no fluid storage capability and therefore the net mass flow must be zero. This is also the case for the evaporator fluids.

The above assumptions are the basis for the design of most HVAC&R systems operating in steady state in which temperature is regulated by cycling the compressor on and off as needed to maintain temperature within a selected range. This represents most of the HVAC&R systems currently in use, including most residential split systems and packaged systems, and simple refrigerators. For such HVAC&R systems, it has been found that the condenser intake fluid temperature $T_{ci}$, evaporator intake fluid temperature $T_{ei}$, and the power parameter P are sufficient to establish a time-invariant relation that can be used to detect system degradation when the vapor compression cycle is operating in steady state.

As well, increased refrigerant temperature in the condenser or evaporator functions generally results in increased refrigerant pressure within the refrigerant loop, and more compressor power is needed to maintain pressure and move the refrigerant through the system. The power required to move the refrigerant through the system is also dependent upon the amount of refrigerant in the loop.

Referring to the simplified view of the HVAC&R system 100 as a black box 200 discussed in FIG. 2, consider the condition where the system experiences fluids at a specific pair of condenser and evaporator intake fluid temperatures ($T_{ei}$,$T_{ci}$), called a temperature tuple (i.e., an ordered list of elements). Consider also that the system is in a "newly maintained" condition and that the mass flow rates across the condenser and evaporator coils are also fixed and nominal. The term "newly maintained" condition as used herein refers to the condition of the HVAC&R system immediately after it has been properly serviced, where the intent of the service is to render the system in the best possible condition (i.e., as close to factory specifications as is practical for the age of the system). As described above, for the system 100 operating in this state, the compressor power consumed should be repeatable, meaning that any time the system 100 experiences this same set of conditions, the power consumed by the compressor should be identical. At the same temperature tuple ($T_{ei}$, $T_{ci}$), any condition that causes a reduction in the rate at which heat is extracted from the condenser coil will increase the temperature of the refrigerant in the condenser, causing the pressure in the condenser to increase, and causing more power to be consumed by the compressor than would be otherwise. These conditions include things that would reduce mass flow rate, such as a failed condenser fan, obstructions in the condenser, including extreme condenser fouling, and surface effects such as condenser fouling, even if ultimately the mass flow rate is not reduced. Thus, if the compressor power for a given set of intake temperatures ($T_{ei}$,$T_{ci}$) is higher than expected, then: 1) something is not right with the system and its efficiency is likely degraded, and 2) a possible cause of the problem is something in the condenser subsystem.

In a similar manner, for the intake fluid temperature tuple ($T_{ei}$,$T_{ci}$), any condition that causes the rate of heat absorption in the evaporator to decrease will cause the average internal temperature of the fluid in the evaporator to decrease, causing pressures to lower, and resulting in reduced compressor power. This includes such phenomena as a fouled evaporator, either via accumulation of dirt or frost, which reduces the rate of heat transfer from the evaporator coil to the evaporator fluid, or anything that causes a reduction in evaporator fluid mass flow, which can include the above, but also includes dirty filters, broken evaporator fan belts and other phenomenon. Thus, again, if the compressor power for a given set of intake temperatures ($T_{ei}$,$T_{ci}$) is lower than expected, then: 1) something is not right with the system and its efficiency is likely degraded, and 2) a possible cause of the problem is something in the evaporator subsystem.

For a fixed pair of condenser and evaporator intake mass flow rates and temperatures equal, the power required to move the refrigerant through the system is a positive definite function of the total amount of refrigerant moved through the system. Importantly, a refrigerant leak, which is quite common in HVAC&R systems and affects both system efficiency and the environment via ozone depletion, appears as a reduction in compressor power.

Thus, for the basic HVAC&R system 100 described above, information regarding the overall health of the system can be obtained from a simple black box model in which a CIPP relation is learned based on the intake fluid temperatures ($T_{ei}$,$T_{ci}$) and a compressor input power parameter P when the system is in the "newly maintained" condition. Once this learned CIPP relation is established, it may be used to predict potential performance degradations and problems based on observations (i.e., measurements) of certain compressor input power parameters. The observed compressor input power parameters may include, for example, the real power, current (e.g., one phase of a 2-phase current), volt-amperes, and the like.

Figure 3:
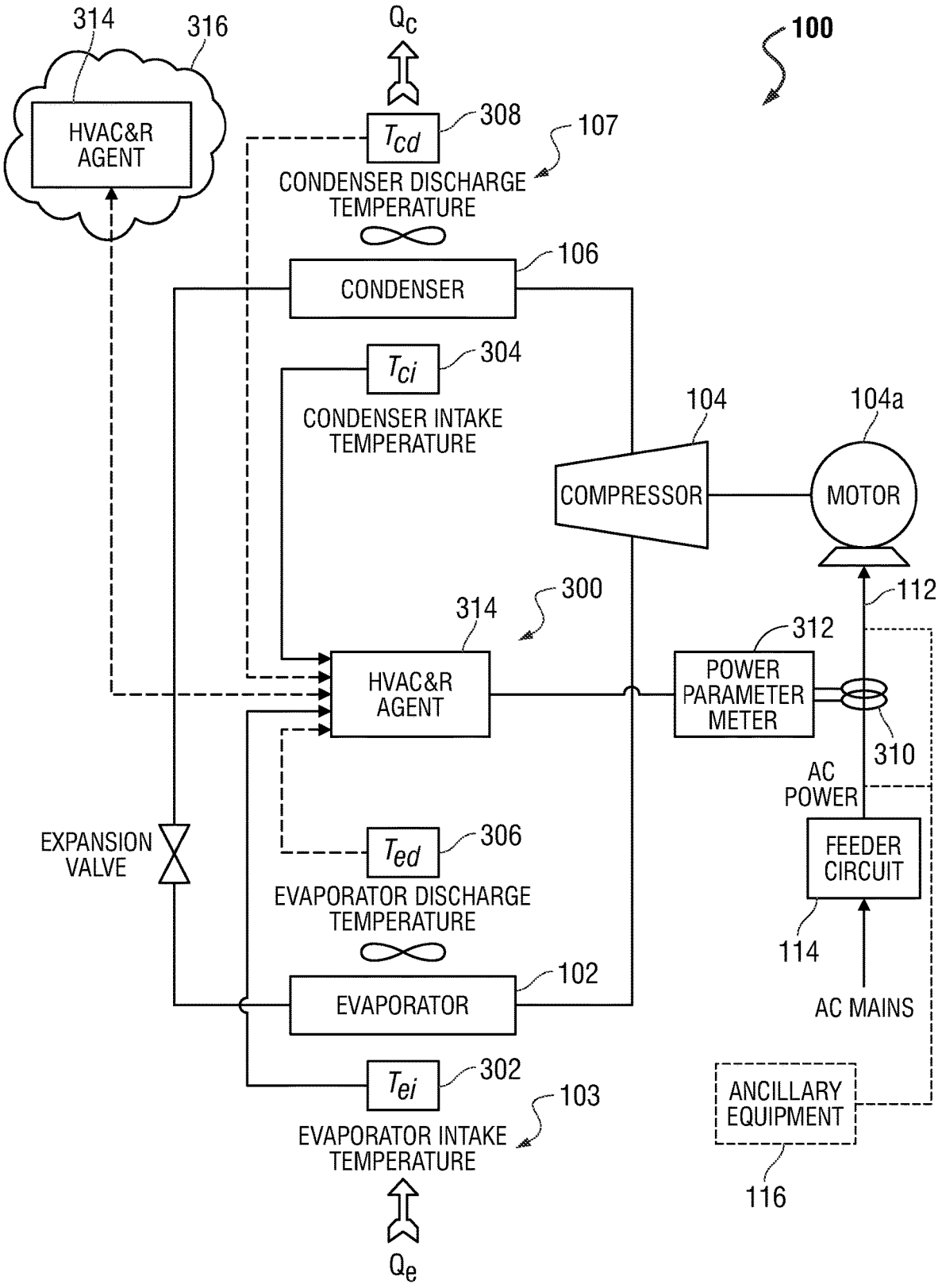
FIG. 3 illustrates an exemplary HVAC&R system equipped with a monitoring and early problem detection system according to aspects of the disclosed embodiments.

Referring next to FIG. 3, an HVAC&R monitoring and early problem detection system 300 has now been installed on the HVAC&R system 100 in accordance with embodiments of the present disclosure. The monitoring and early problem detection system 300 is designed to use the CIPP relation discussed above to monitor for performance degradation in the HVAC&R system 100. To this end, the system 100 is equipped with a plurality of temperature sensors, such as sensors 302, 304, 306, and 308, mounted at selected points on the system. These temperature sensors 302, 304, 306, and 308 acquire selected temperatures measurements that may be used by the monitoring and early problem detection system 300: (i) a condenser intake fluid temperature $T_{ci}$; (ii) a condenser discharge fluid temperature $T_{cd}$; (iii) an evaporator intake fluid temperature $T_{ei}$, generally referred to as the "return" temperature in commercial and residential direct exchange air conditioning; and (iv) an evaporator discharge fluid temperature $T_{ed}$, generally referred to as the "supply" temperature in commercial and residential direct exchange air conditioning systems.

Although four temperature measurements were mentioned, the monitoring and early problem detection system 300 can operate using only two of the four temperature measurements: either the intake or discharge fluid temperature of the evaporator ($T_{ei}$ or $T_{ed}$), and either the intake or discharge fluid temperature of the condenser ($T_{ci}$ or $T_{cd}$), depending on the particular implementation. For example, in one embodiment, the monitoring and early problem detection system 300 may use the fluid temperature $T_{ei}$ at the intake of the evaporator 102 and the fluid temperature $T_{ci}$ at the intake of the condenser 106. Accordingly in one embodiment, a temperature sensor 302 is mounted at or near the intake of the evaporator 102 to measure the evaporator intake fluid temperature $T_{ei}$, and a second temperature sensor 304 is mounted at or near the intake of the condenser 106 to measure the condenser intake fluid temperature $T_{ci}$. Alternatively, the condenser discharge fluid temperature $T_{ed}$ may be substituted for $T_{ci}$ or the evaporator discharge fluid temperature $T_{ed}$ may substituted for $T_{ei}$ in some embodiments. In such embodiments, a third temperature sensor 306 may also optionally be mounted at the discharge of the evaporator 102 to measure the evaporator discharge fluid temperature $T_{ed}$, or a fourth temperature sensor 308 may also optionally be mounted at the discharge of the condenser 106 to measure the condenser discharge fluid temperature $T_{ed}$. These temperature sensors 302, 304, 306, and 308 may be any suitable temperature sensors known to those skilled in the art, including voltage-based temperature sensors that employ thermocouples or thermistor devices.

In addition to the intake fluid temperature measurements, measurements of a compressor input power parameter are also obtained for the monitoring and early problem detection system 300. Examples of compressor input power parameter measurements that may be obtained include measurements of current, voltage, real power, reactive power, and apparent power. As discussed further below, the compressor input power parameter that is usually measured is current, due to the relatively low cost of current measurement equipment compared to power meters and the like. And as a practical matter, for measurements of real power, most power meters and other power measurement devices already need to acquire current measurements. Thus, compressor input current is almost always one of the compressor input power parameters measured.

In a typical residential installation, the compressor 104 (and motor 104*a*) is fed via the branch feeder circuit 114 by a mains AC power line 112, which may be a 3-wire single-phase power line having a mid-point neutral. Other configurations are also possible, including two-wire AC systems and 3-phase AC configurations. Thereafter, one or more current detection devices 310, such as one or more toroidal-type current transformers, may be mounted on the wires of the compressor power line 112. The outputs of the one or more current transformers 310 are then provided to a power parameter meter 312, which may be any commercially available power meter or a meter that can measure currents, such as RMS current, flowing through the power line 112. Some models of the power parameter meter 312 may also incorporate measurements of line voltage, such as models that measure real power and apparent power (Volt-Amps), in single or polyphase form. An example of a commercial power meter that may be used as the power parameter meter 312 is any of the PM8xx series power meter manufactured by Schneider Electric with associated circuitry to measure real power. In systems where the line voltage is maintained constant, or at least repeatable with respect to the configuration of compressor(s) 104 in the system, a simple clamp-on current transformer that can measure the current of one leg of the compressor 104 may also be sufficient.

For embodiments where the CIPP relation is being used to estimate the compressor input current, the equipment may include one or more current transformers and other current-measuring devices. Current-measuring devices are available that can provide an indication of the RMS current flowing through the power line 112 over a specified current range. In these embodiments, the RMS current delivered to the compressor 104 alone may suffice as the compressor input power parameter measurements. An example of current-measuring device suitable for some HVAC&R applications is a Veris H923 split-core current sensor from Veris Industries that can provide a 0-10 Volt signal in response to a 0-10 Amp RMS current. Other similar current-measuring devices or systems may be employed, appropriate to the expected levels of current in the system.

In some embodiments, instead of (or in addition to) compressor input power parameter measurements, the process of learning the CIPP relation described herein may be performed using an indication of the power being consumed by the HVAC&R system 100 as a whole, via the branch feeder circuit 114. As noted earlier, many branch feeder circuits have current or power measurement capability built in to their circuit breakers or otherwise embedded that can provide a signal indicative of the input power being used by the system. Some ancillary equipment 116, such as electrical disconnect boxes and the like, include similar current or power measurement capability. Thus, although the present disclosure describes the CIPP relation learning process mainly with respect to compressor input power parameter measurements, those having ordinary skill in the art will appreciate that the relation may also be learned in a similar manner using the alternative (or additional) input power indicators mentioned above.

The measured current or other compressor input power parameter measurements may then be used along with either the intake or discharge fluid temperature of the evaporator ($T_{ei}$ or $T_{ed}$), and either the intake or discharge fluid temperature of the condenser ($T_{ei}$ or $T_{ed}$), to establish the CIPP relation. In some embodiments, and by way of an example only, the particular fluid temperature measurements used may be measurements of the evaporator intake fluid temperature $T_{ei}$ and the condenser intake fluid temperature $T_{ei}$. This is the arrangement depicted in FIG. 3. In other implementations, the fluid temperature measurements used may be measurements of the evaporator discharge fluid temperature $T_{ed}$ and the condenser discharge fluid temperature $T_{ed}$. In still other implementations, a combination of condenser intake and evaporator discharge temperatures may be used, or a combination of condenser discharge and evaporator intake temperatures may be used.

The fluid temperature measurements (from the sensors 302, 304, 306, and/or 308) along with the compressor input power parameter measurements (from the power parameter meter 312) may then be provided to a HVAC&R monitoring application or agent 314 for determining an expected compressor input power based on the CIPP relation. The HVAC&R monitoring agent 314 may then compare the expected compressor input power to an observed (i.e., measured) compressor input power to detect potential system degradation and problems. The fluid temperature and compressor input power measurements may be provided to the monitoring agent 314 over any suitable signal connection, including wired (e.g., Ethernet, etc.), wireless (e.g., Wi-Fi, Bluetooth, etc.), and other connections. For example, the measurements from the sensors 302, 304, 306, and/or 308 may be provided to the monitoring agent 314 as part of the Internet of Things (IoT).

In some embodiments, the monitoring agent 314 may be implemented as a cloud-based solution or a fog-based solution where a portion or all of the monitoring agent 314 resides or is hosted on a network 316. The network 316 may be a remote network such as a cloud network, or it may be a local network 316 such as fog network. Such a monitoring agent 314 (or portions thereof) may also be integrated into a so-called "smart" thermostat for an air conditioning system or an HVAC&R controller. The "smart" thermostat or HVAC&R controller may include any programmable device that is capable of being configured to input a plurality of data signals (e.g., analog, digital, etc.), execute an algorithm or software routine based on those data signals, and output one or more data signals (e.g., analog, digital, etc.). Other examples of commercially available devices that may be adapted for use with the monitoring agent 314 include commercially available programmable logic controllers (PLC) and building management systems (BMS), both manufactured by Schneider Electric Co.

Figure 4:
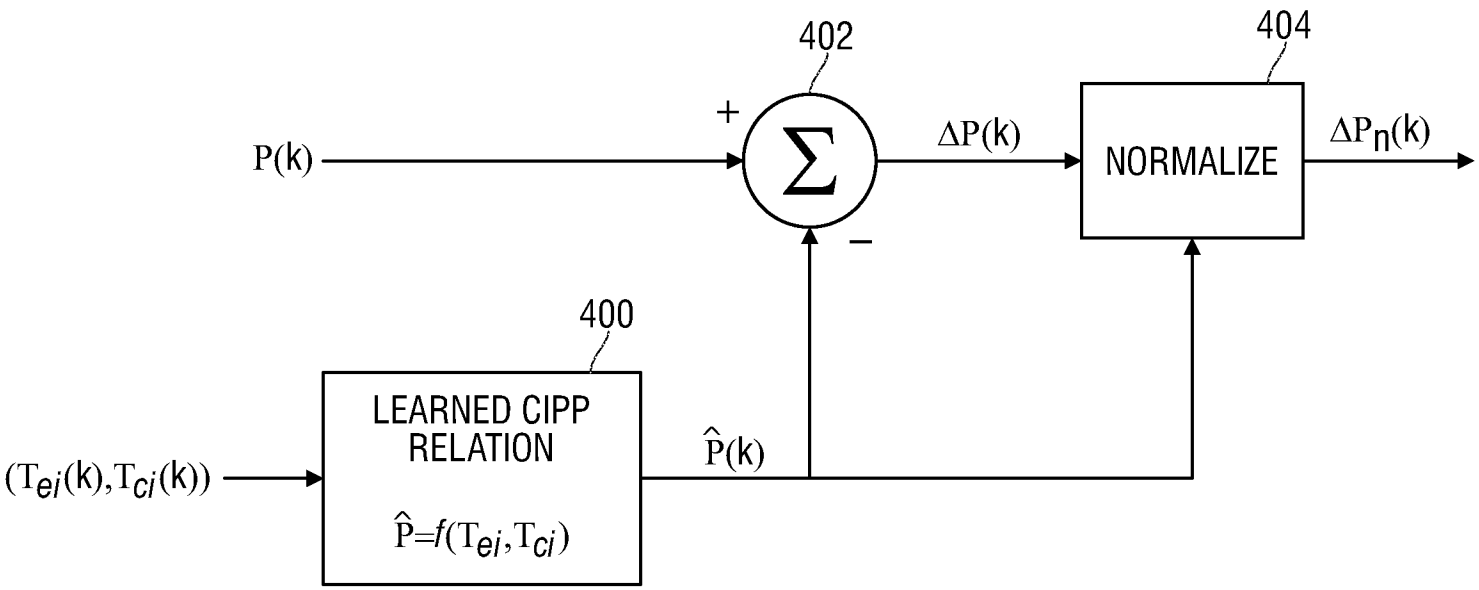
FIG. 4 illustrates block diagram showing exemplary operation of the monitoring agent according to aspects of the disclosed embodiments.

FIG. 4 shows a conceptual block diagram illustrating how an agent may use a learned CIPP relation to produce a time series of normalized residuals to detect potential performance degradations and problems early in the system 100. In the figure, P(k) is the observed compressor input power parameter of the system 100 for a given observation k. In some implementations, observations are also simultaneously made for the evaporator intake fluid temperature $T_{ei}(k)$ and the condenser intake fluid temperature $T_{ci}(k)$. The term "simultaneously" means the measurements are taken quickly in time relative to the thermal time constants of the system 100. Preferably, the temperature and compressor input power parameter measurements for a given observation are obtained within a time window of several seconds, and preferably by a PLC (programmable logic controller) based process. Such automated measurement processes can typically obtain measurements at a rate that is more than sufficiently high for the monitoring purposes herein. The system 100 should also be in steady state when the measurements are obtained, meaning the system has been operating for a long enough time that the refrigerant in the system is in the proper physical state (i.e., liquid or vapor) throughout the system, and heat transfer is proceeding at a substantially constant rate (e.g., within 1%-2%) in both the condenser and the evaporator.

In FIG. 4, for each observation k, the evaporator intake fluid temperature and the condenser intake fluid temperature tuple ($T_{ei}(k)$, $T_{ci}(k)$) is applied to a prediction block 400 where the agent uses the observation and learned CIPP relation to predict the value of the power parameter representing the system in newly maintained condition. From the prediction block 400, the agent generates a predicted value of the compressor input power parameter, $\hat{P}(k)$, as a function of the learned CIPP relation, as shown in Equation (1):

$$\hat{P}(k)=f(T_{ei}(k),T_{ci}(k)) \quad (1)$$

The predicted value of the compressor input power parameter $\hat{P}(k)$ and an observed value of the compressor input power parameter, P(k), that was included in the observation are then combined at a summing node 402. The summing node 402 produces a difference compressor input power parameter value, ΔP(k), according to Equation (2):

$$\Delta P(k)=P(k)-\hat{P}(k) \tag{2}$$

The agent thereafter normalizes the difference compressor input power parameter value ΔP(k) at a normalization block 404 to produce a normalized residual compressor input power parameter, R(k), as shown in Equation (3):

$$R(k)=\frac{\Delta P(k)}{\hat{P}(k)} \tag{3}$$

As Equation (3) shows, the normalized residual R(k) is the ratio of the difference between the measured and the predicted values of the compressor input power parameter ΔP(k) over the predicted value of the power parameter $\hat{P}(k)$. The normalized residual R(k) can then be expressed as a percentage by multiplying by 100 to show the percent difference between the expected value of the compressor input power parameter and the observed value of the compressor input power parameter, according to Equation (4):

$$\%\ R(k)=100*R(k) \tag{4}$$

Properly analyzed, a normalized residual or a time sequence of normalized residuals can be used as an indicator of system degradation. If the system is in newly maintained condition and in the absence of measurement error, the normalized residual should be zero, and deviation from newly maintained condition can be inferred from a non-zero normalized residual. Furthermore, the normalized residual is empirically observed to have properties beneficial to facilitate continuous learning of the CIPP relation even while the system is experiencing performance degradation. In particular, while the power consumed by the compressor is a sensitive function of the temperature tuple ($T_{ei}$, $T_{ci}$), the normalized residual is approximately or quasi-temperature independent. This means that a normalized residual computed at one temperature tuple is observed to have approximately the same value at any other temperature tuple within the operating temperature range of the system while the physical condition of the system remains unchanged. This observation allows the agent to "correct" power parameter measurements for degradation for purposes of learning a CIPP relation in a manner to be described subsequently.

Figure 5:
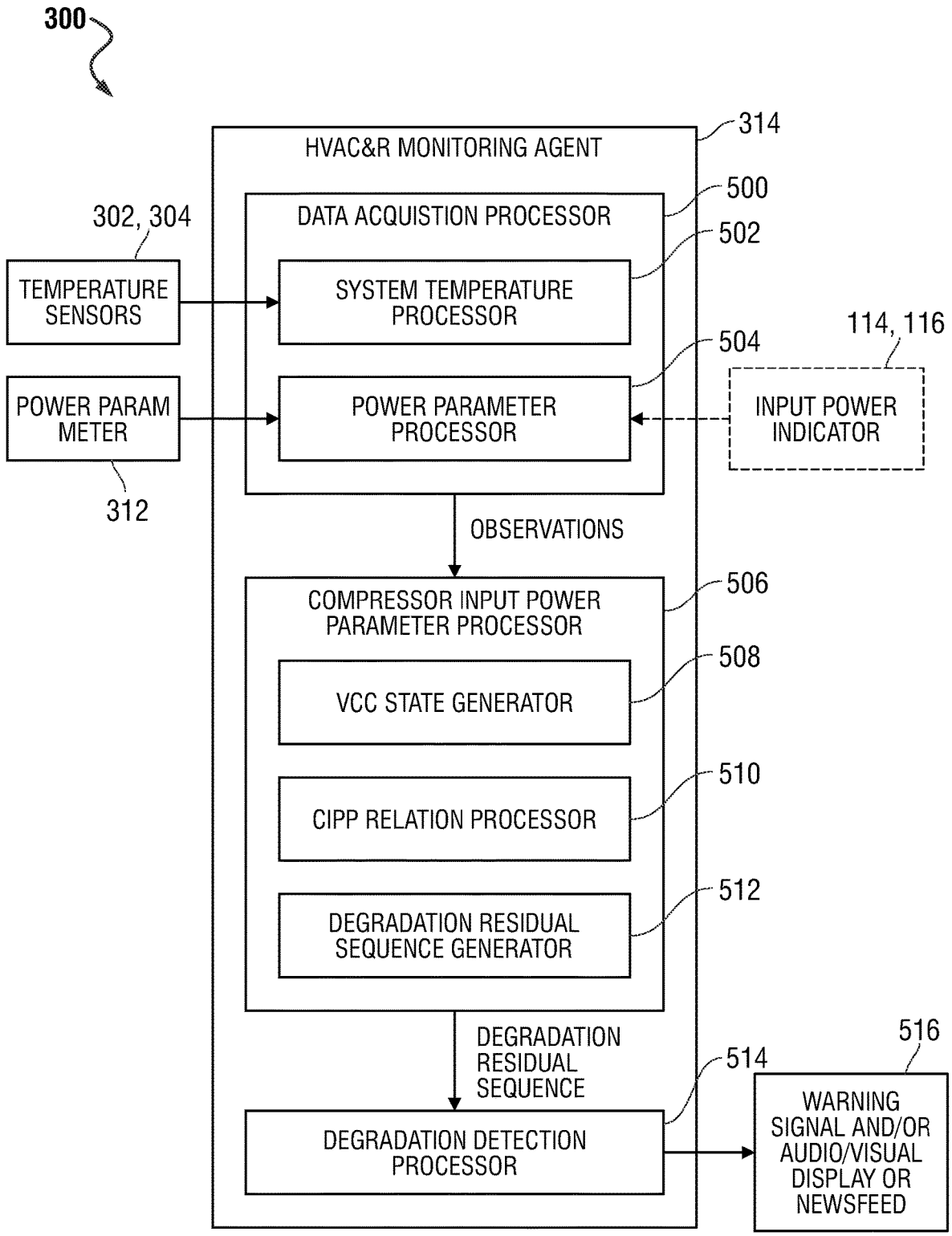
FIG. 5 illustrates an exemplary implementation of a monitoring agent according to aspects of the disclosed embodiments.

FIG. 5 illustrates an exemplary implementation of the HVAC&R monitoring application or agent 314 from FIG. 3. The HVAC&R monitoring application or agent 314, or simply "agent," may be composed of several functional components, including a data acquisition processor 500, a compressor input power parameter processor 506, and a degradation detection processor 514, and a number of sub-components that are discussed in more detail further below. Each of these functional components 500, 506 and 514 (and sub-components) may be either a hardware based component (e.g., run by an ASIC, FPGA, etc.), a software based component (e.g., run on a network, etc.), or a combination of both hardware and software (e.g., run by a microcontroller, etc.). In addition, while the functional components 500, 506 and 514 (and sub-components) are shown as discrete blocks, any of these blocks may be divided into several constituent blocks, or two or more of these blocks may be combined into a single block, within the scope of the disclosed embodiments. Following is a description of the operation of the various functional components 500, 506 and 514 (and sub-components).

The data acquisition processor 500 operates to acquire and store fluid temperatures and power parameter values continuously and from these values pre-processes and assembles them into time sequences of observations that can be used by the compressor input power parameter processor 506. The compressor input power parameter processor derives certain operational information from the time sequence of observations and selectively uses the observations to learn a relation between temperatures and a power parameter. It then uses the learned relation along with the observations to generate a time sequence of normalized residuals that contain information regarding the physical condition of the HVAC&R equipment monitored. This sequence of normalized residuals is passed to the degradation detection processor 514, which interprets the time sequence of normalized residuals, and can issue warning signals or audio visual displays or sends information via newsfeeds 516 indicating potential problems with the HVAC&R system.

The data acquisition processor 500 operates to acquire and store fluid temperatures and power parameter values continuously and from these values and optionally other inputs, assembles and pre-processes them into observations that can be used by the compressor input power parameter processor 506. While there are many ways to accomplish the above, as previously mentioned, programmable logic controllers, such as the model M251 manufactured by Schneider Electric, are ideally suited for this task. In the example shown, the data acquisition processor 500 includes a system temperature acquisition processor 502 which operates to acquire and store fluid temperature measurements for the agent 314 continuously or on a regular basis. The data acquisition processor 500 also includes a power parameter acquisition processor 504 which acquires and stores measurements of one or more compressor input power parameters as measured by the power parameter meter 312 (see FIG. 3) continuously or on a regular basis. These one or more compressor input power parameters may include real power, reactive power, apparent power, voltage, and current consumed by the compressor 104. Alternatively, as explained above, where the agent 314 is being used to predict compressor input current, measurement of the RMS current delivered to the compressor 104 by itself may suffice.

The temperature measurements and the power parameter measurements are often referred to herein as "observed" temperature and power. In some embodiments, the data acquisition processor 500 collects and assembles sets of measurements of fluid temperatures and power parameters into "observations". Temperatures and power parameters in an observation are represented by a single number representative of the corresponding temperature or power parameter at an instant or over an interval of time. The number representing the corresponding temperature or power parameter may be a single measurement or may be derived as a function of a plurality of measurements, such as the average of a number of measurements taken over the interval to be represented by the observation. Other functions are, of course, possible using well understood digital signal processing techniques.

Table 1 below shows an exemplary observation that may be provided by the data acquisition processor 500 to the compressor input power parameter processor 506.

TABLE 1

| Exemplary Observation | | | |
|---|---|---|---|
| Time Stamp (optional) | $T_{ci}$ | $T_{ei}$ | Power Parameter P |
| Date/Time represented by observation | Sensor Reading(s) | Sensor Reading(s) | Sensor Reading(s) |

In Table 1, the exemplary observation contains $T_{ci}$ data and $T_{ei}$ data that each include a condenser or evaporator intake temperature measurement, respectively, or signal processed batch of such temperature measurements, representative of the external temperatures of the system at a point in time or over an interval of time. These fluid temperature measurements are acquired from the temperature sensors 302, 304 located at or near the evaporator and condenser intakes, as shown in FIG. 3. In other embodiments, the evaporator exhaust temperature $T_{ed}$ and the condenser exhaust temperature $T_{cd}$ may instead be the fluid temperature measurements acquired and preprocessed by the system temperature processor 502. Alternatively, room temperature measurements (e.g., from a thermostat) may be used as a proxy for measurements of the evaporator intake fluid temperature $T_{ei}$ rather than directly measuring the evaporator intake fluid temperature in direct exchange air conditioning applications or as a proxy for the condenser intake fluid temperature $T_{ci}$ in heat pump applications and many refrigeration systems. In refrigeration applications (including freezers), the temperature of the internal compartment directly cooled by the evaporator may be used as a proxy for evaporator intake temperature. Other temperature proxies that track or are suitably responsive to the various intake and discharge temperatures discussed herein may also be used within the scope of the disclosed embodiments. These include measured outdoor temperatures or temperature estimates obtained from weather services or forecasts.

Further, an observation may also contain power parameter data in some embodiments, including a measurement, or function of measurements per above, for one or more power parameters measured by the power parameter meter 312 at the same or near in time to the temperature measurements. An example of a power parameter than can be included as power parameter data in the observation is the compressor input current.

Also shown in Table 1 is an optional time stamp or tag indicating the date and time instant or interval represented by the measured temperature and power parameter values included in the observation. In some implementations, including a time stamp or tag in an observation or data frame from which the date and time intended to be represented by each measurement in an observation can be inferred can be beneficial to the implementation. The time stamp or tag is particularly useful when individual observations are stored in databases for future retrieval, or when a group or batch of several observations are assembled into a data frame, which may then be transferred across network communication links. For example, data frames of observations may be sent over the Internet to a web service where the agent 314 (or portion thereof) reads the data frames, processes the observations within data frames (using the time tags as needed to maintain order), and provides the result for appropriate action by the HVAC&R monitoring and early problem detection system 300. In other embodiments, such as in building management systems, PLCs, and dedicated controllers, an observation would proceed serially through the system directly without intermediate storage beyond delay lines required to determine steady state operation. In these systems, an observation generally does not need to be associated with a time tag.

The time sequence of observations are forwarded from the data acquisition processor 500 to the compressor input power processor 506 either one at a time or in a batch data frame as described above. In accordance with the disclosed embodiments, the compressor input power parameter processor 506 is operable to derive or learn the CIPP relation and use the relation to monitor the system for performance degradation from the observations provided by data acquisition processor 500. To this end, the compressor input power parameter processor 506 may include a VCC state generator 508 to derive certain timing information from the sequence of observations provided by the data acquisition processor 500 and augment the observations with this information resulting in a sequence of steady state observations, and a CIPP relation processor 510 used to learn a CIPP relation from the augmented time sequence of steady state observations provided by the VCC state generator 508. Also included is a degradation residual sequence generator 512, which uses the learned CIPP relation and the time sequence of steady state observations to compute a time sequence of normalized residuals, labeled degradation residual sequence, indicative of the condition of the HVAC&R system. And as mentioned, the degradation detection processor 514 analyzes the degradation residual sequence produced by the degradation residual sequence generator 512 to detect and report degradation.

Predictions of the compressor input power parameter using the embodiments described herein are most accurate after the system has been operational long enough that refrigerant states have stabilized in the system. While the actual time required to stabilize refrigerant states can vary depending on the equipment, stabilization generally occurs within about 3 to 5 minutes of operation. To this end, the VCC state generator 508 can detect, using appropriate logic or circuitry, whether the compressor is an ON or OFF state and whether the system is in a steady state and likely stable, or in a transient state and likely unstable. As one example, logic may be implemented to declare that the compressor is an ON state or OFF state by comparing the power parameter against a minimum threshold value for that parameter, declaring the compressor to be in an ON state when the power parameter for an observation is greater than the threshold value and in an OFF state when the power parameter for the observation is less than the threshold value. Because measurements can be noisy, the VCC state generator 508 can implement logic to debounce the compressor ON or OFF state by requiring that the power parameter value be greater than or less than the threshold for a number of sequential observations prior to changing an internally managed compressor state variable from OFF to ON or ON to OFF, respectively. The VCC state generator can declare that the system is stable for purposes of the CIPP relation when the compressor has been detected in an ON state for longer than a contiguous interval of, for instance, 5 minutes. Otherwise, the system can be declared not stable.

Figure 6:
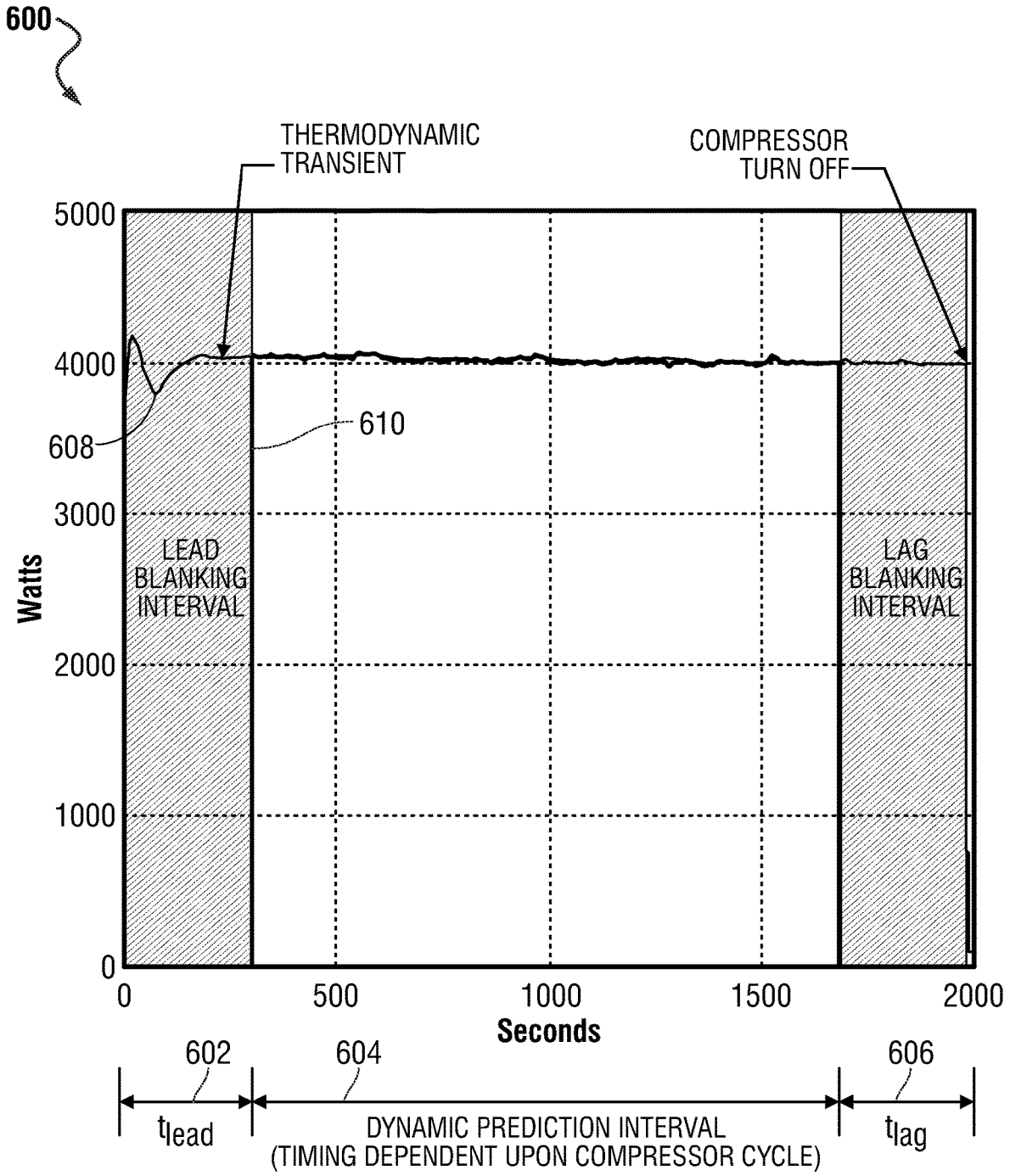
FIG. 6 illustrates a graph showing steady state operation of the HVAC&R system according to aspects of the disclosed embodiments.

FIG. 6 illustrates what is meant by "steady state" operation of the VCC cycle, dividing a single VCC cycle into three intervals of operation. In FIG. 6, a graph 600 of real power (watts) versus time (seconds) is shown for a typical "on" cycle of a single compressor system like the system 100 described above. A graph of compressor current over the interval would look similar. The graph 600 also shows the predicted compressor input power using the CIPP relation learned for this system over this particular compressor cycle. From the graph, three different intervals of operation can be identified over the compressor cycle, including a lead blanking interval 602, a dynamic prediction interval 604 where the power should be predictable from the learned relation described above, and a lag blanking interval 606. As a practical matter, only observations in the dynamic prediction interval 604 are useful for training the agent to learn the CIPP relation and to predict equipment condition using this relation. Observations over this dynamic prediction interval are the "steady state observations" referred to previously.

The lead blanking interval 602 refers to the interval immediately after a compressor has been turned on. When the compressor has been off and subsequently turned on, there is a transient period that follows where the power consumed, indicated by line 608, is a function not only of the temperatures and mass flow rates, but also of the elapsed time since the compressor turned on. This transient period is in large part system dependent. While the transient behavior may be repeatable, it is not predictable using the time invariant CIPP relation. The lead blanking interval 602 is best needed to ensure observations made during this interval are discarded. In general, the lead blanking interval 602 should be set long enough to allow the refrigerant loop to reach a "steady state" operation, which can vary depending upon the size and type of system. For instance, in a residential refrigerator, the lead blanking interval may be set to as little as 20-30 seconds and the entire compressor cycle may only last a minute or two, whereas in a large rooftop unit, lead blanking intervals 602 on the order of 5-10 minutes may be required and the compressor may run for hours or even over the course of a day. In some large chillers, blanking intervals as long as 30 minutes and longer are appropriate and the chiller may run for days uninterrupted.

The dynamic prediction interval 604 refers to the interval when the HVAC&R system has reached a thermal steady state. Observations made during this interval 604 can be used to inform the CIPP relation and the subsequently learned CIPP relation can be applied to predict the power, indicated by line 610, that should be consumed to support the temperatures and mass flow rates of the condenser and evaporator fluids. In the simplest of HVAC&R systems, the condenser and evaporator intake temperatures is sufficient to accurately predict the compressor input power, provided nothing has physically changed in the system. As can be seen from FIG. 6, the predicted power 610 very accurately tracks the measured power 608 when the system is operating properly, with instantaneous normalized residuals on the order of 0.01-0.02 typically, and normalized residuals averaged over time very near zero. The dynamic prediction interval 604 lasts until just before the compressor again changes to the off state.

The lag blanking interval 606, shown greatly exaggerated in FIG. 6 refers to an interval when the compressor again changes to the off state and is included primarily to facilitate the needs of a sampled data system. As mentioned above, once the HVAC&R system reaches a thermal steady state, the CIPP relation can be used to accurately predict the compressor power. However, in a sampled data system, especially in systems in which the sample period is long relative to the transient response of the motor driving the compressor, there can be considerable uncertainty as to when the compressor actually turned off. In some sampled data systems, the value presented in an observation is an average over a number of samples taken internally at a much higher sample rate than the period of observations presented by data acquisition processor 500 to the compressor input power parameter processor 506. Accordingly, if a compressor turns off somewhere between observations, the observation may contain a random estimate of the actual value of the power parameter averaged over the part of the observation where the compressor is actually on, roughly uniformly distributed between zero (where the compressor has turned off at the start of the observation interval) and an actual legitimate average (where the compressor turns off at the very end of the observation interval).

Furthermore, as is common in most sampled data systems, a "debounce" period is imposed in which, once the compressor is recognized by the agent to be in the on state, the agent needs to observe that the consumed power parameter has fallen below a certain threshold power level before recognizing that the compressor has changed to an off state. Over this "debounce" interval, which varies in duration depending on the system, the measured power may not agree with the power predicted using the CIPP relation. The lag blanking interval 606 thus defines a period in which the agent watches for the compressor to change from an On and stable state to an Off state and also ignores those observations over that interval. As a practical consideration, the lag blanking interval 606 can be short relative to the lead blanking interval.

The agent needs to detect a state transition by the compressor in order to avoid making or using invalid values of normalized residual, and thus a time lag is needed between when an observation is made and when the corresponding normalized residual is computed, or presented, to ensure that the calculation represents operation in the dynamic prediction interval 604. This can be done by deferring calculating the normalized residual until the observation can be confirmed as being within the dynamic prediction interval. One means to accomplish this is to specify an assumed lead blanking delay time and lag blanking delay time explicitly, with values chosen as system level constants as part of the design.

The VCC state generator 508 may augment an observation obtained from data acquisition processor 500 with system state information in the form of Boolean variables in some embodiments. The Boolean variables may take the values in the set {TRUE, FALSE} to represent the system state. The VCC state generator 508 can set the Boolean variables to TRUE to indicate that the system is stable (within the dynamic prediction interval per FIG. 6) and in an On state, respectively per above, and FALSE to indicate otherwise. In some implementations, the agent may associate derived system state information such as that above with each observation, resulting in an augmented observation. Table 2 below shows an example of such an augmented observation.

TABLE 2

| Augmented Observation | | | | |
|---|---|---|---|---|
| Time Stamp (optional) | $T_{ci}$ | $T_{ei}$ | Power Parameter P | System State |
| Date/Time represented by observation | Sensor Reading(s) | Sensor Reading(s) | Sensor Reading(s) | Compressor On/Off (TRUE/FALSE), Transient/ Steady State (FALSE/TRUE) |

Observations for which the VCC state generator has declared the system operation to be stable are referred to as "steady state" observations and in some implementations, the VCC State Generator can select only the steady state observations for further processing resulting in a sequence of steady state observations produced one at a time, or in a batch or data frame dependent upon specific details of implementation. In other implementations, using the state information augmented by VCC state generator 508, the other components in compressor input power prediction manager 506 can determine which augmented observations are relevant for their individual functions as needed.

The CIPP relation processor 510 is responsible for learning the relation between the intake temperatures and the compressor input power parameter values associated with those temperatures from the steady state observations described above. This CIPP relation processor 510 includes three main functions that provide capabilities desirable for building a CIPP relation that represents the HVAC&R system in newly maintained condition. In some embodiments, the CIPP relation processor 510 compiles and maintains a novel temperature map relating the intake temperatures and compressor input power parameter values likely to represent the HVAC&R system in newly maintained condition associated with those temperatures. In some embodiments, the agent uses a 2-stage bootstrap learning strategy combined with a reference degradation estimator function to modify in some cases the power parameter values of steady state observations prior to using the modified observations to populate the temperature map. This approach provides several improvements over prior solutions for detecting performance degradation in HVAC&R systems. Prior solutions used a so-called lumped regression approach in which a large set of observations was obtained with the system operating in steady state over a relatively long period of time. The large data set was intended to be obtained while the system was in "newly maintained" condition and assembled into a training data set and a test data set, and machine learning was used to create a model of the system from the training set. The machine learning employed a linear regression algorithm to establish a relation between the power parameter and certain measured temperature inputs. The test data set was then applied to the model to confirm that the model could indeed represent the characteristics of the actual system. An estimate of what the power parameter "should have been" with the system still in newly maintained condition could then be computed using the model and subsequent temperature inputs. The estimated power parameter could thereafter be compared to an observed power parameter to provide an indication of system health.

A limitation of prior solutions was the large data set required, which usually took a long time to assemble, especially where the training was customized to an individual HVAC&R system. Accurate predictions of expected power parameter values were deferred until the training was complete. For example, for an air conditioning system operating in a moderate climate, an entire cooling season of data might be needed to ensure that all expected external conditions are observed, for instance, because average and peak outdoor temperatures in May are generally considerably cooler than average and peak outdoor temperatures in August in most places in the United States.

Another limitation of prior solutions was that the HVAC&R system needed to remain in a "newly maintained" condition throughout the training interval to build an accurate model. This was not practical when the training interval took several weeks or months to complete due to the large training data set required. Yet another practical limitation is the collection and storage of vast amounts of observations for training data may not be feasible except in cloud-based solutions that have large storage capacity, as solutions that reside more proximate to the HVAC&R system typically have much smaller storage capacity.

Another benefit of using a temperature map over prior art solutions is that the agent can detect when the temperature tuple of a steady state observation lies outside a range where a prediction can be confidently made and can therefore choose not to predict rather than run the risk of predicting an erroneous value of the corresponding power parameter. This can serve to greatly reduce the chance of generating a "false positive" condition in which degradation is declared when no problem exists, or a "false negative" condition declaring the system to be in good condition when it is, in fact, degraded. Prior art systems, including those using large data sets and regression, inherently suffer from this problem.

In some implementations, the agent builds the temperature map using the steady state observations provided by the VCC state generator 508 above, each steady state observation including at least one temperature tuple ($T_{ei}$, $T_{ci}$) and a corresponding compressor power parameter. Each quantized temperature tuple ($T_{ei}$, $T_{ci}$) forms an index into the temperature map. For each indexing temperature tuple, the agent "learns" by updating summary data for the cell from the sequence of power parameter values of steady state observations corresponding to the tuple. The agent updates the summary data for a given cell in this manner until a sufficient number of observations have been applied, as described later herein. At this point, the agent stops updating the summary data for that cell and the summary data of the cell can be used to make predictions of the power parameter value representing the system in newly maintained condition. Power parameter predictions in some cases may derive directly from the summary data of an individual cell indexed by a tuple of a steady state observation once the requisite number of observations have been made for that cell. In other cases, the agent may derive a power parameter prediction for a tuple of a steady state observation by performing local regression using summary data from nearby tuples according to the rules described herein.

With the above approach, the agent can gather data quickly and begin making power parameter predictions almost immediately. In some cases, the agent can begin making power parameter predictions within the same day that the HVAC&R system is commissioned, provided the system is running and is in newly maintained state. Using the temperature map described herein, the agent can assess whether a prediction of the power parameter corresponding to a given temperature tuple is likely to represent the characteristics of a system in newly maintained condition and decide whether or not to issue a prediction. The ability to assess the reliability of a prediction greatly reduces the possibility of the agent providing false positives and false negatives. Additionally, because the CIPP relation can be assumed to be quasi-temperature independent (as discussed further herein), the agent can continue to learn the characteristics of the HVAC&R system in newly maintained condition while the system is degrading, thereby compensating for the degradation so the predictions better represent the system in newly maintained condition.

Continued learning of the CIPP relation by the agent can be achieved by updating the temperature map as additional temperature and power parameter data becomes available. In some embodiments, the temperature map is updated in batches, whereby a group of observations are assembled into one or more data frames of steady state observations and presented to the compressor input power parameter processor 506 of the agent by the data acquisition processor 500 as a batch of observations. The batches of observations may be acquired on an hourly, daily, or other time base, and presented to the agent as a time sequence. It is also possible in some embodiments to provide the observations on an individual observation basis, one at a time as they are received.

In some embodiments, the temperature map is built by using the evaporator intake temperature $T_{ei}$ and the condenser intake temperature $T_{ci}$ over a particular temperature range of interest. Assuming a quantization of 0.1 deg. C. (other quantization levels may of course be used) and a temperature range from 10 to 40 deg. C., the resulting temperature map would be a 300×300 table (with 90,000 cells). A partial example of an exemplary temperature map is shown in Table 3 below, where the cells of the map contain summary values for the compressor input power parameter observed for each temperature tuple ($T_{ei}$, $T_{ci}$). Although the table is shown as being mostly filled, in general, only those cells for which the values of $T_{ei}$ and $T_{ci}$ have been observed will contain summary values.

TABLE 3

Exemplary Temperature Map

| | | $T_{ci}$ (° C.) | | | | |
|---|---|---|---|---|---|---|
| | | 10.0 | 10.1 | 10.2 | . . . | X |
| $T_{ei}$ (° C.) | 10.0 | C00 | C10 | C20 | . . . | CX0 |
| | 10.1 | C01 | C11 | C21 | . . . | CX1 |
| | 10.2 | C02 | C12 | C22 | . . . | CX2 |
| | . . . | . . . | . . . | . . . | . . . | . . . |
| | Y | C0Y | C1Y | C2Y | . . . | CXY |

As mentioned above, each cell (e.g., C00, C01, C02, etc.) in the temperature map contains summary values for the observations corresponding to the temperature tuple ($T_{ei}$, $T_{ci}$) that serves as an index into the cell. These summary values, also called summary statistics or sample statistics in some cases, provide summary information about the steady state observations represented by the cell. For example, summary values may provide information about the data in the data set, such as the sum total, the mean, the median, the average, the variance, the deviation, the distribution, and so forth.

As described previously power parameter values of steady state observations are computed from measurements by power or current meters that are specially designed for the purpose. However, real world measurements may nevertheless be noisy due to operational and/or environmental variability. The temperature map therefore inherently incorporates realistic conditions whereby some power parameter values in the cells may be corrupted with noise. These real-world conditions may be described as a stationary zero-mean additive random noise process, Noise$(0,\sigma^2)$, where $\sigma^2$ is the variance. Each value of steady state power parameter can then be expressed as shown in Equation (6):

$$P=P_o(T_{ei},T_{ci})\text{Noise}(0,\sigma^2) \tag{5}$$

where $P_0(T_{ei},T_{ci})$ is the underlying, power parameter value of the observation.

In one embodiment, the agent applies one of two functions of power parameter values from the steady state observations to populate and update the summary values of the cells in the temperature map of Table 3. One of the functions applied is an identity function, in which the value of the power parameter itself is the result of the function. When compensating the learning process for system degradation, the agent may apply a second, time varying compensation function, the details of which will be described subsequently. In what follows, the term $f_p(P, n)$ will be used to describe the result of applying the appropriate function to the power parameter value, P, of the $n^{th}$ steady state observation, used to update a specific cell. To reduce the measurement noise present in a real system, the agent builds and maintains summary data for each cell that can be stored in the cell and used for computing sample statistics for the power parameter corresponding to the indexing temperature tuple. In some embodiments, the summary data of each cell includes the following summary values:

$$\text{Sum of values observed, } \Sigma_{n=1}^{N} f_p(P,n) \tag{6}$$

$$\text{Sum of the squares observed, } \Sigma_{n=1}^{N} f_p^2(P,n) \tag{7}$$

where N is the total number of observations stored in the sums, a value which is also stored as an element of the summary data in the cell. In other words, each time the agent updates the summary data in a cell, it does the following:

a. Applies the appropriate function to the value in the steady state operation, represented by Equation (5), resulting in the value $f_p$ (P, n);
b. Adds the value $f_p$ (P, n) to the sum of values observed, described by Equation (6);
c. Computes the square of $f_p(P, n)$, resulting in the value $f_p^2(P, n)$;
d. Adds the value $f_p^2(P, n)$ to the sum of squares observed, described by Equation (7); and
e. Increments the value of N to reflect the update.

These summary values can then be used by the agent to compute the mean and variance of the power parameter value corresponding to the cell as required.

Additionally, for each cell of the temperature map, in some implementations, the agent maintains two metadata: (1) an indication of whether enough observations were made at the particular temperature tuple represented by the cell such that summary statistics represented by the cell can be designated as valid for purposes of prediction; (2) an indication of whether one or more observations used in forming the summary statistics of the cell were modified to compensate for system degradation.

The first metadata can be stored as a Boolean variable, for example "OBSERVED," with the variable set to TRUE to indicate that sufficient observations were made, and FALSE to indicate otherwise. Entries in the temperature map are populated as rapidly as possible with enough observations such that the mean of the observations stored can be used to reliably predict the power parameter, while stopping population of the entries in the map when the number of observations is sufficient that, under normal conditions of noise, additional observations are not likely to change the sample mean of the cell significantly. Thus, in some embodiments, a temperature tuple ($T_{ei}$, $T_{ci}$) is defined to be observed and the "OBSERVED" metadata variable set to TRUE when a minimum of four observations have been made and the agent stops adding information to the cell at this point. This approach has the effect of limiting the data stored in the cell to that most likely to reflect a newly maintained condition of the system and also serves as an aid to allowing the agent to begin predicting the system condition quickly.

The "OBSERVED" metadata variable is in some sense optional, as it is derived from the already stored summary data value N. However, maintaining this variable so it is "set" only once, can reduce processing times, and is an aid to understanding the principles and teachings herein.

The second metadata can be also stored as a Boolean variable, for example "COMPENSATED," with TRUE indicating that the time-varying compensation function has been applied to at least one of the steady state observations used in forming the summary data of the cell, and FALSE indicating that none of the steady state observations used in forming the summary of the cell were compensated for system degradation using the compensation function. Further details are provided with respect to the discussion of FIG. 10 below.

Thus, each cell in the temperature map stores at least the following exemplary variables and corresponding data therefor: "SV" {summary data}, "COMPENSATED" {TRUE/FALSE} and optionally "OBSERVED" {TRUE/FALSE}.

An estimate of the mean power parameter value for an entry in a cell of the temperature map may be computed from the summary quantities using Equation (8):

$$\bar{P} = \frac{\sum_{n=1}^{N} f_p(P, n)}{N} \tag{8}$$

where $\bar{P}$ is the mean power parameter value, while an estimate of the variance $\sigma^2$ of the power parameter values accumulated may be computed using Equation (9):

$$\sigma_P^2 = \frac{1}{N}\sum_{n=1}^{N} f_p^2(P, n) - \bar{P}^2 \tag{9}$$

Equation (8) is useful in predicting the power parameter value most likely to represent the HVAC&R system in newly maintained condition at the temperature tuple values of the corresponding steady state observations when the methods taught subsequently herein are applied. Equation (9) can be used as an indicator of the "fidelity" of the prediction, with low variance indicating that the values forming the sum were all nearly the same and high variance indicating otherwise.

If the physical HVAC&R system could remain in newly maintained condition long enough to acquire observations over the entire range of temperature tuples likely to be encountered by a system over one or more weather seasons of operation, the temperature map so constructed using only the identify function would be sufficient to characterize the system completely. Unfortunately, as discussed previously, this is unlikely in general, and so a means is now described to permit learning of the system characteristics of a "newly maintained" system while the system is degrading in performance.

It should be recalled here that in some embodiments each observation includes a timestamp indicating the date and time when the observation was obtained while in other embodiments the agent can implicitly keep track of the date and time of a given observation or simply the time elapsed from a reference time. Learning involves the agent using the compressor power parameter and the condenser and evaporator intake temperatures to build sample statistics for the cells of the temperature map that can be used to predict power parameter values of the equipment in "newly maintained" condition as described above and may best be illustrated with the aid of the exemplary timing diagram of FIG. 7. The timing diagram 700 generally begins once the agent has been commissioned or otherwise deployed and it is assumed that when learning begins, the HVAC&R equipment is in "newly maintained" condition. Once these conditions are met and learning is enabled, learning of the power parameter characteristics starts with receipt of an initial valid observation (i.e., an observation obtained during steady-state operation) at 702. The steady state observation is presented to the agent and is preferably the first steady state observation received after the above considerations are met. Learning continues with receipt of additional steady state observations over a learning interval 704 that is defined by a learning interval system constant. After the learning interval 704 is completed, the agent is considered to have adequately learned the characteristics of the HVAC&R system, which characteristics should not vary over time in the absence of system degradation once this is learned. If the system has degraded and subsequently restored to a newly maintained state, the relation should once again reflect the newly maintained characteristics of the system without further training.

Figure 7:
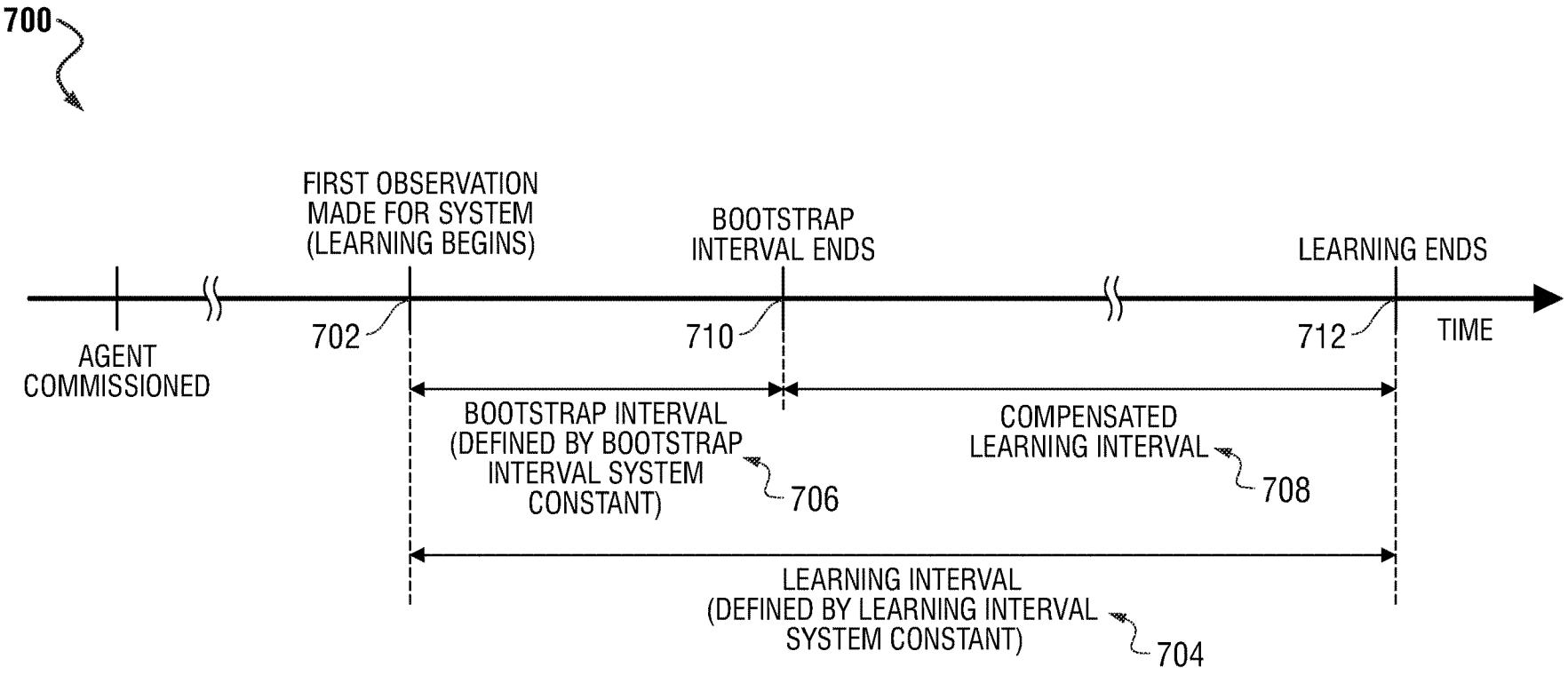
FIG. 7 illustrates a timing diagram for building a temperature map according to aspects of the disclosed embodiments.

As FIG. 7 shows, the learning interval 704 includes two constituent intervals, a "bootstrap" interval 706, and a compensated learning interval 708. The "bootstrap" interval 706, as the name implies, jumpstarts the learning process for the agent. It is assumed that the physical HVAC&R system begins and remains in newly maintained condition during the bootstrap interval, and during this interval the agent applies the identity function described above to power parameter values of the steady state observations to update the sample statistics of the corresponding cells. In other words, during the bootstrap interval, the agent uses the unmodified values of the power parameter entries of steady state observations to update the sums of the SV portion of the corresponding cells per above when the steady state observations are within the bootstrap interval (i.e., $f_p(P, n)=P$).

The bootstrap interval 706 begins with receipt of the initial steady state observation at 702 and ends after a predefined duration dictated by a bootstrap interval system constant at 710. The bootstrap interval 706 can be as short as a few days, but in practice may need to be set as high as the first 30 days of system operation, depending on the particular HVAC&R system.

Following the bootstrap interval is a compensated learning interval 708 over which the assumption that the system remains in newly maintained condition is relaxed and during which the agent can modify the values of power parameter in steady state observations using the time-varying compensation function referenced above to compensate for estimated degradation prior to updating the sample statistics of a cell. When the agent updates a cell during the compensated learning interval 708, it sets the COMPENSATED metadata variable of that cell to TRUE to indicate that at least one of the power parameter values used to update the sample statistics of the cell was modified using the compensation function. The compensated learning interval 708 starts at 710 at the end of the bootstrap interval and continues until the end of the learning interval at 712, completing the learning interval 704. In some embodiments, a typical value for the learning interval 704 is on the order of 120 days, although fewer or greater number of days may certainly be used.

Once the learning interval 704 is completed, the learning by the agent is considered sufficient for the purposes herein and the temperature map is considered to be fully representative of the expected operation of the HVAC&R system, so that no further learning by the agent is needed.

Compensating the power parameter values prior to updating the sample statistics during the compensated learning interval 708 is facilitated by a time-varying reference degradation generator function, next described. Cells of the map declared to be "observed" during the bootstrap interval 706 (i.e., OBSERVED=TRUE) are likely most representative of the system in a newly maintained state because a) they represent the observations temporally nearest the time when the system was placed in newly maintained condition, and b) enough observations have been made that the sample statistics of the cell are likely representative of the actual characteristic of the system at that tuple. Since these cells have been declared TRUE during the bootstrap learning interval 706 above, it follows that the COMPENSATED metadata variable associated with the cell is FALSE. Cells having this particular property, OBSERVED=TRUE, COMPENSATED=FALSE are referred to herein as "reference cells". For these cells, the mean value of the power parameter given by Equation (8) is an estimate of the power parameter value of the equipment in newly maintained condition for the corresponding temperature tuple. Since the OBSERVED=TRUE metadata variable indicates that the agent will no longer update the summary statistics of this cell, the power parameter estimate for this cell so generated is now a constant.

In the bootstrap interval 706 above, the agent assumes that the HVAC&R system remains in newly maintained condition, which is a reasonable assumption if the bootstrap interval is short in duration. It has been observed that, in practice, the relation between temperature and any normalized residual R (see Equation (4)) is quasi-temperature independent, at least for levels of degradation not normally considered extreme. The term "quasi-temperature independent" as used herein means that the normalized residual R defined above is approximately independent of the observed temperature tuple ($T_{ei}$,$T_{ci}$) over the working range of temperatures of the HVAC&R system, so long as the physical condition of the equipment does not change. Experience has shown that this is true in practice, at least for relatively small magnitude of normalized residuals in the range of temperatures considered "normal" and begins to be violated as the system degrades to levels that would suggest a service call for maintenance.

Consider an HVAC&R system in which the above assumptions hold true and for which the characteristics of the system have been learned and the temperature map has acquired a number of reference cells during the bootstrap interval 704, but not all cells in the temperature map meet the conditions for a reference cell. Further, assume that a sufficient number of reference cells have been acquired that the agent can use those cells when encountered by the agent in subsequent steady state observations to predict the "newly maintained" value of the power parameter for an observation at least some of the time using the mean value of the power parameter for the indexed reference cell computed per Equation (8) above as the prediction, $\hat{P}$. For a steady state observation for which the agent indexes a reference cell, the agent can subsequently compute a normalized residual $R_S$ from Equations (2) and (3) with P as the power parameter value of the observation and $\hat{P}$ as computed above. Because of the quasi-temperature independence assumption, the normalized residual $R_S$ value computed under these conditions should be independent of the temperature tuple as described above and hence the cell in the temperature map used to make the prediction. In other words, any steady state observation that references one of these cells should yield (approximately) the same value of $R_S$, so long as the physical condition of the HVAC&R system does not change.

In the absence of system degradation and measurement noise, the residual R s should be zero or near-zero, as the predicted power parameter should be equal to the power parameter value of the observation. System degradation, as understood in the art, appears as a bias in $R_S$ and this bias has been demonstrated to be beneficial for detecting system degradation. The sequence of resulting individuals residuals $R_S$, designated $R_S$ (m), where the index m indicates the $m^{th}$ such residual computed by the agent in this way, can be used to infer the evolution of degradation of the system.

Ideally, the normalized residual $R_S$ (m) will represent the true normalized difference between the measured power parameter value and what the power parameter value would be with the equipment in newly maintained condition, but the power parameter of the steady state observation used in computing the reference residual value $R_S$ (m) is assumed corrupted by additive noise as described above (see Equation (5)). As a result, the sequence of reference normalized residuals may be somewhat noisy. By appropriate signal processing (e.g., filtering), an estimate of the normalized residual sequence can be made such that the effects of the noise in the observations is relatively insignificant.

In some implementations, the agent uses a simple filter, such as an EWMA (Exponentially Weighted Moving Average) filter, to reduce the noise in the reference residual sequence. One general form of such a filter is shown in Equations (13) and (14):

$$x(m+1)=\beta x(m)+(1-\beta)u(m) \tag{10}$$

$$y(m)=x(m+1) \tag{11}$$

where x(m) is an internal state variable for the $m^{th}$ update of the filter, u(m) is the $m^{th}$ value of the input sequence to the filter; the normalized residual, y(m) is the $m^{th}$ output of the filter and β is the EWMA filter time constant which determines how quickly the filter responds to changes in the input residual. In the computation of a system residual estimate per above, the input sequence u(m) is the series of residuals $R_S$ (m) computed by the agent's residual estimator function per above, and the output sequence y(m) is denoted $R_{sys}$ (m). An exemplary value for β is 0.98 in some embodiments.

As a next inventive step, suppose $R_{sys}$ represents the most recent estimate of the system degradation level in the form of a normalized residual. Suppose also that a steady state observation with power parameter P is made within the compensated learning interval 708 for which the cell in the temperature map represented by the temperature tuple does not meet the requirement for an observed cell, that is, the OBSERVED metadata variable for this second cell is set to FALSE. Since $R_{sys}$ is representative of the entire system, then from Equation (3) above, an adjusted value of the observed power parameter, $f_p$(P, n), that is more closely representative of what would have been observed in the absence of system degradation can be defined from $R_{sys}$ and P using Equation (3), as follows:

$$R_{sys} = \frac{P - f_p(P, n)}{f_p(P, n)} \tag{12}$$

Equation (12) can then be solved for the adjusted value of the power parameter:

$$f_p(P, n)) = \frac{P}{R_{sys} + 1} \quad (13)$$

The adjusted observation $f_p$ (P, n) from Equation (13) above represents the agent's best estimate of what the observation P should have been had there been no system degradation and is based on the value of $R_{sys}$ at the time of the steady state observation. Updating the summary statistics of the cell corresponding to this observation with the "corrected" value $f_p$ (P, n) instead of the original power parameter P should better represent the operation of the equipment in newly maintained condition. It is this value that is used by the agent to update the sample statistics of a cell during the compensated learning interval.

The above discussion provides a way to extend the temperature map beyond the cells that can be fully learned during the bootstrap interval 706. The process of maintaining the temperature map for an individual observation is described in further detail in FIG. 8.

Figure 8:
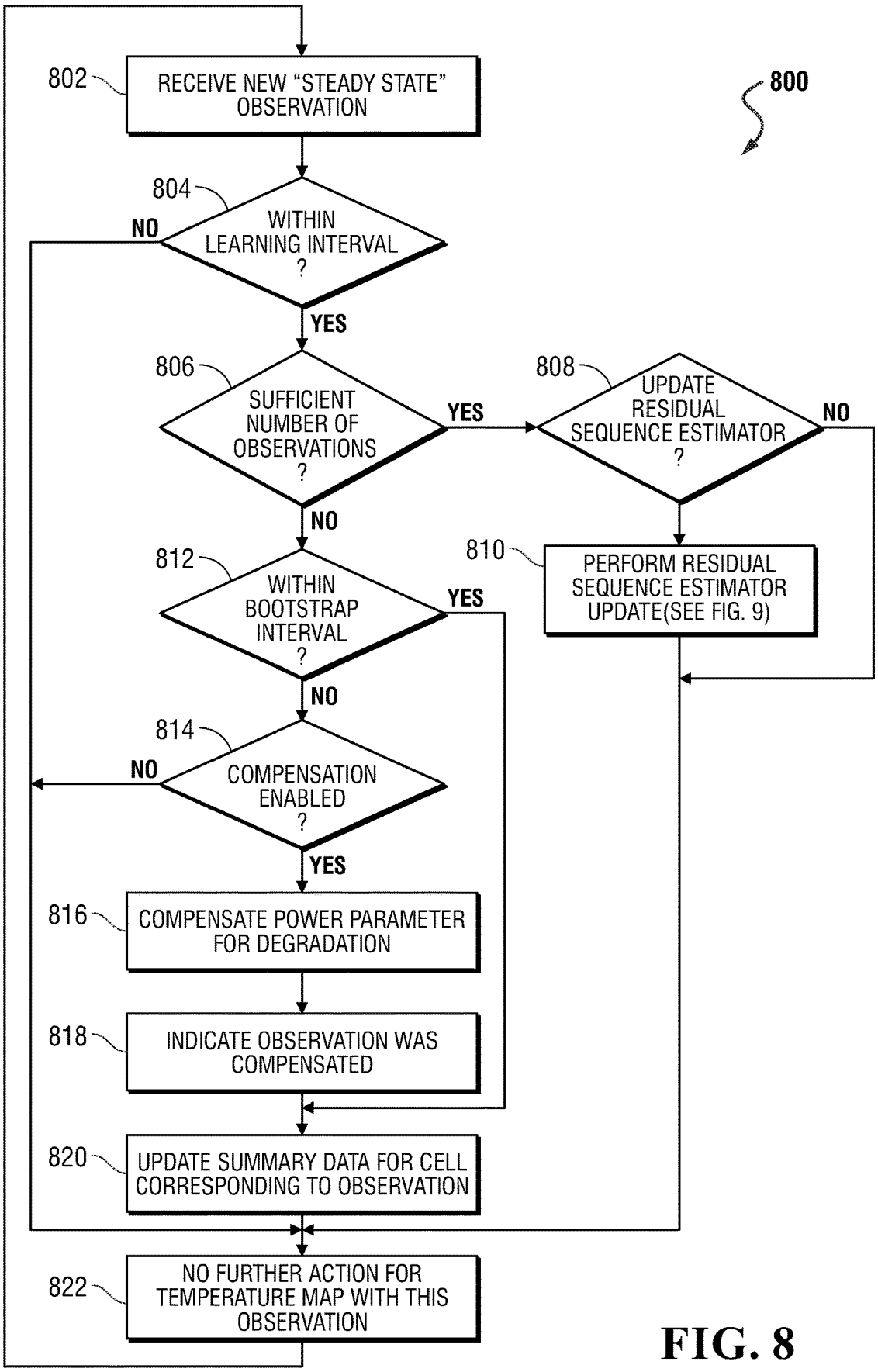
FIG. 8 illustrates a flowchart for determining whether to compensate an observation according to aspects of the disclosed embodiments.

Referring to FIG. 8, a flow chart 800 is shown illustrating a method that may be used by or with the agent to maintain the temperature map for an individual observation. The method generally begins at 802 when the agent receives a new steady state observation for a given temperature tuple ($T_{ei}$, $T_{ci}$). At 804, the agent checks whether the time of the observation is within the learning interval (704). If not, then the observation is not used for maintaining the temperature map, and the agent proceeds to 822 where no further action is taken for the temperature map with respect to this observation. If it is determined at 804 that the observation was obtained within the learning interval (704), then the agent determines at 806 whether a sufficient number of observations have already been obtained (e.g., OBSERVED metadata variable for the cell corresponding to the temperature tuple ($T_{ei}$, $T_{ci}$) is TRUE).

If the determination at 806 is yes, then at 808 the agent determines whether to update a residual sequence estimator for the observation being processed (e.g., is COMPENSATION metadata variable set to TRUE?). If no, then the observation being processed is not a candidate for updating the residual sequence estimator $R_{sys}$, and the agent proceeds to 822 where no further action is taken for the temperature map with respect to this observation. If the determination at 808 is yes (e.g., COMPENSATION metadata variable is TRUE), then the agent proceeds at 810 to update the residual sequence estimate $R_{sys}$ referenced above. This estimator update function, which is further described in reference to FIG. 9 below, provides two details that are useful for maintaining the temperature map during the compensated learning interval (708). First, the function updates the value of the residual sequence estimator $R_{sys}$. Second, it provides indication to the agent whether subsequent observations made within the compensated learning interval (708) should be compensated for system degradation prior to being used to update the temperature map. In some embodiments, this indication may be in the form of a Boolean system state variable, such as COMPENSATION_ENABLED, the generation of which will be defined subsequently in the presentation of FIG. 9. Following the update of the $R_{sys}$ estimate, the agent proceeds to 822, where no further action is taken for the temperature map update with this observation.

Referring back to 806, if a sufficient number of observations have not been obtained for this cell (e.g., OBSERVED metadata variable is FALSE), then the agent continues to process the observation as a candidate for updating the temperature map by determining at 812 whether the observation was obtained during the bootstrap interval (706). If the time of the observation lies within the bootstrap interval (706), then the agent uses the observation to update the cell corresponding to the temperature tuple of the observation at 820 by updating the summary data for the cell using the identity function above (and also updating the OBSERVED metadata variable in the process).

If the determination at 812 is no, meaning the observation was not inside the bootstrap interval (706), but was instead within the compensated interval (708), then the agent determines at 814 whether the observation should be compensated for degradation (e.g., COMPENSATION_ENABLED state variable is TRUE) for the cell. If not (e.g., COMPENSATION_ENABLED state variable is FALSE), then the agent takes no further action for temperature map at 822. If observation compensation was enabled for the cell (e.g., COMPENSATION_ENABLED state variable is TRUE), then at 816 the agent compensates the power parameter included in this observation for degradation by computing $f_p$ (P, n) using Equation (13) above, and indicates at 818 that the observation has been compensated (e.g., by setting COMPENSATED metadata variable to TRUE). The agent thereafter updates the summary data for the cell at 820 using the adjusted value of the observed power parameter $f_p$ (P, n) (and also updates the OBSERVED metadata variable in the process). At this point, no further action is taken for the temperature map with respect to this observation.

Figure 9:
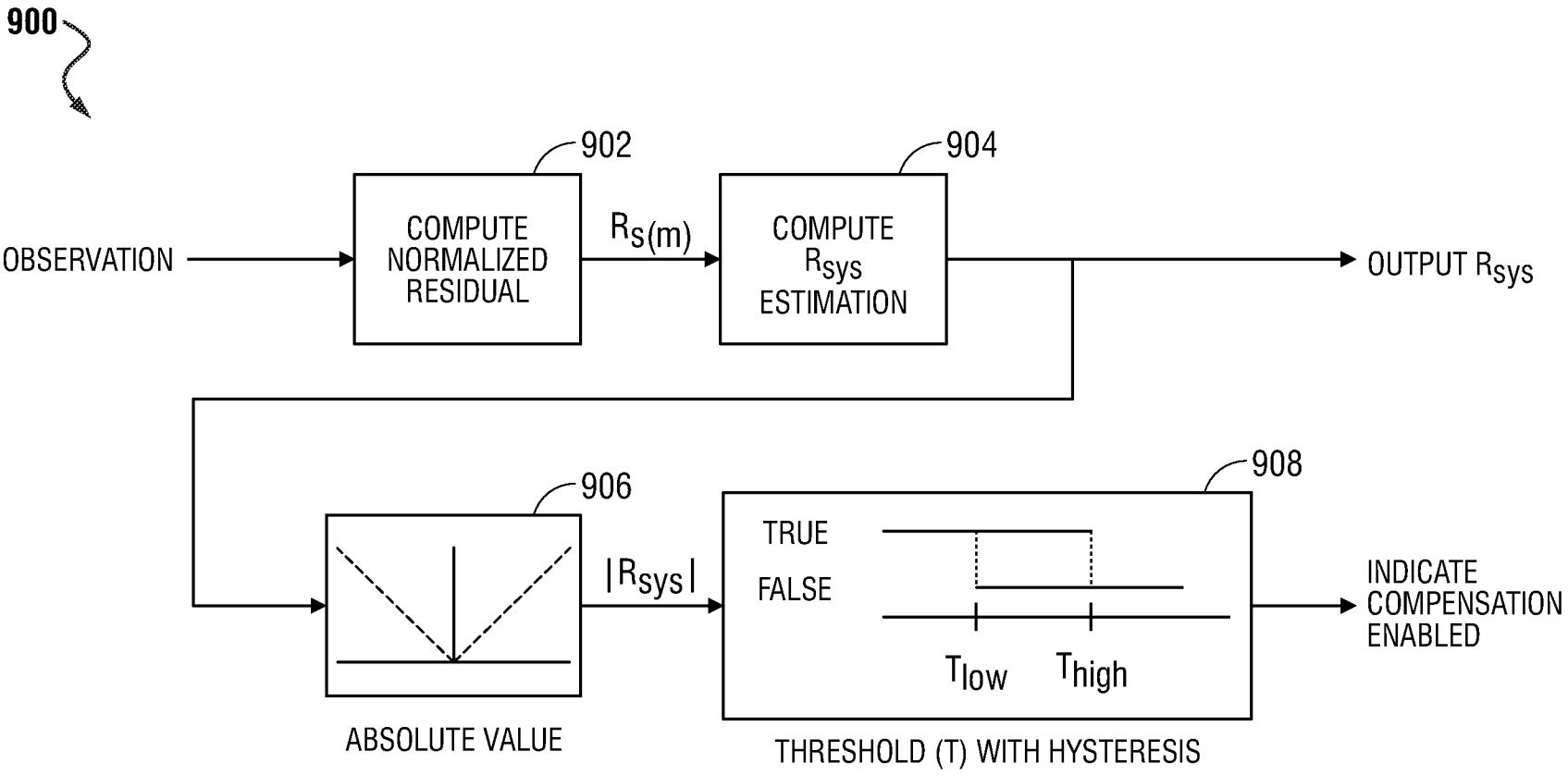
FIG. 9 illustrates a functional block diagram for updating a residual sequence estimator according to aspects of the disclosed embodiments.

FIG. 9 is a functional diagram 900 showing additional details of the R sys estimator update process 900 referenced in FIG. 8. This estimator update process 900 provides the most recently updated value of the system degradation level, the residual sequence estimator R sys, and updates the value of the COMPENSATION_ENABLED state variable. The process generally begins at 902 where the agent computes a normalized residual of the present observation using the CIPP relation learned from the temperature map. According to the logic of FIG. 8 discussed earlier, the cell corresponding to the temperature tuple ($T_{ei}$, $T_{ci}$) for this observation has the OBSERVED metadata variable set to TRUE, and the COMPENSATED metadata variable of the cell is set to FALSE. From the summary data of this cell, the agent computes the predicted value $\hat{P}(n)$ as the mean value of the power parameter $\overline{P}(n)$, as given by Equation (8) above. From this predicted value $\hat{P}(n)$ and the observed value of the power parameter in the observation, the normalized residual $R_S$ can be computed by Equations (2) and (3) above. The agent then feeds this normalized residual into an $R_{sys}$ estimator at 904, which may be a simple filter, such as an EWMA filter described above, that computes and outputs an $R_{sys}$ estimation.

The notion that the system residual sequence $R_{sys}$ (m) is representative of the behavior of the system at any tuple in the temperature map is dependent upon the assumption that the residuals are quasi-temperature independent. This assumption has been observed to be reasonable when the magnitude of the residual sequence is small. The assumption begins to break down as the condition of the equipment degrades to the point that service is needed to bring the equipment back into proper function. In practice, it has been shown that when the magnitude of normalized residuals consistently exceed about 4% to 5%, service is usually warranted, and that well before these limits are reached, the quasi-temperature independence assumption begins to break down. Attempting to compensate an observation for degradation under these conditions may have uncertain effects once the equipment is brought back into newly maintained state.

Accordingly, in some embodiments, the agent maintains a Boolean system state variable, COMPENSATION_ENABLED, to limit the degradation compensation process based on the present value of $R_{sys}$ as computed by the $R_{sys}$ estimator 904. In one implementation, the value of $R_{sys}$ just computed by the $R_{sys}$ estimator 904 is the input to an absolute value function 906, the output of which is shown as $|R_{sys}|$. The absolute value $|R_{sys}|$ is then fed to a compensation threshold function 908, which operates based on a preset compensation limit and composition hysteresis. These parametric inputs are system dependent and may be represented by variables "CompensationLimit" and "CompensationHysteresis" in some embodiments. Typical values of these parameters are 0.02 and 0.002, respectively. These two parameters work together to create two threshold values, labeled $T_{low}$ and $T_{high}$ according to:

$$T_{low}=\text{CompensationLimit}-\text{CompensationHysteresis} \tag{14}$$

$$T_{high}=\text{CompensationLimit}+\text{CompensationHysteresis} \tag{15}$$

The output of this compensation threshold function 908 is the Boolean system state variable COMPENSATION_ENABLED mentioned above, which serves to indicate to the agent whether the system residual $R_{sys}$ is within a range to assume valid for applying degradation compensation. In some embodiments, upon initialization of the system, the state variable COMPENSATION_ENABLED is set to TRUE. If, after updating $R_{sys}$ and subsequently $|R_{sys}|$ the $m^{th}$ value of $|R_{sys}|$ is less than $T_{low}$, the $m^{th}$ value of the COMPENSATION_ENABLED state variable is always set to TRUE. Similarly, if the $m^{th}$ value of $|R_{sys}|$ is greater than $T_{high}$, the COMPENSATION_ENABLED state variable is always set to FALSE. For values of $|R_{sys}|$ in the range $T_{low} \leq |R_{sys}| \leq T_{high}$, the value of the COMPENSATION_ENABLED state variable remains unchanged.

The foregoing discussion has thus far focused largely on defining the temperature map and how the map may be populated using observations obtained during a stable state ("steady state"), providing degradation compensation when necessary and appropriate. Following is a discussion of the degradation residual sequence generator 512 from FIG. 5 which uses the temperature map to compute a sequence of normalized residuals for steady state observations furnished by the data acquisition processor 500 to the compressor input power parameter processor 506. The degradation residual sequence generator 512 determines for the temperature tuple of a steady state observation whether a prediction made by the agent is likely to represent the newly maintained condition of the HVAC&R system and if it determines this is so, proceeds to compute the prediction and generate a normalized residual for that steady state observation. If it is determined that a prediction made is not likely to represent the newly maintained condition of the equipment, no prediction is made and a normalized residual having a "null" value is computed.

Figure 10:
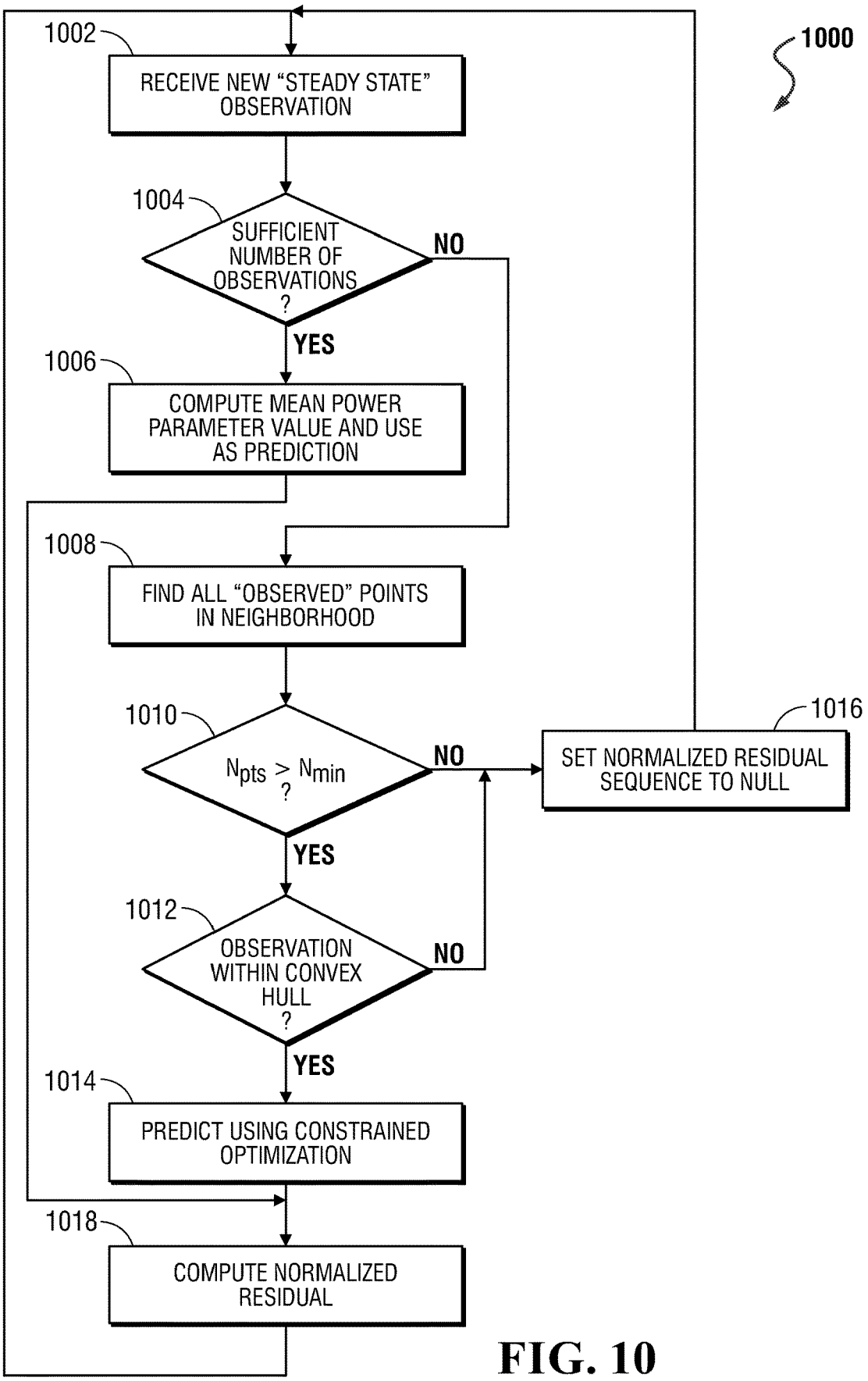
FIG. 10 illustrates a flow chart for determining whether to make a CIPP prediction according to aspects of the disclosed embodiments.

The method is best understood in reference to FIG. 10, which shows a flow chart 1000 that illustrates the process used to predict what the value of the compressor input power parameter should be if the HVAC&R system is in "newly maintained" condition for purposes of degradation detection, and computes the resulting normalized residual. The flowchart generally begins at 1002 where the agent receives or is presented the $n^{th}$ steady state observation of the sequence of steady state observations furnished by VCC state generator 506 with temperature tuple ($T_{ei}$, $T_{ci}$). The next action taken by the agent at 1004 is to determine whether enough observations have been obtained for the OBSERVED metadata value of the cell of the temperature map at the location indexed by the temperature tuple ($T_{ei}$, $T_{ci}$) to be set TRUE. If yes, then at 1006, the agent extracts the sample statistics from the cell and computes a mean power parameter using Equation (8) above. This mean power parameter value is issued as the predicted power parameter, and flow transfers to computation block 1018, where the normalized residual is computed from the predicted power parameter value and the power parameter value of the observation according to Equations (2) and (3) above, resulting in the $n^{th}$ element of the degradation residual sequence $R_d(n)$. Having computed the normalized residual, the agent returns to 1002 to receive the next steady state observation.

If the determination at 1004 is No (e.g., OBSERVED metadata variable is FALSE), then the agent attempts, beginning at 1008, to predict the power parameter using possible observations in the temperature map that are near the given temperature tuple ($T_{ei}$, $T_{ci}$). To this end, in 1008 the agent defines a "neighborhood" of temperature tuples that are within +/−δ degrees of the given temperature tuple in both $T_{ei}$ and $T_{ci}$ with a typical 6 of 0.5 deg. C. Thus, for instance, if the $n^{th}$ steady state observation of the system results in a temperature tuple ($T_{ei}(n)$,$T_{ci}(n)$), then the agent searches all temperature map cells (points) that satisfy Equations (16) and (17):

$$T_{ei}(n)-\delta \leq T_{ei} \leq T_{ei}(n)+\delta \tag{16}$$

$$T_{ci}-\delta \leq T_{ci} \leq T_{ci}(n)+\delta \tag{17}$$

For the above search, the agent only considers temperature map cells for which the "OBSERVED" metadata variable has been set to TRUE in some embodiments, as discussed above or otherwise tested for the condition. The agent then generates a prediction if and only if the following two criteria are satisfied. First, the search results in a minimum number of temperature map cells for which the "OBSERVED" metadata variable has been set to TRUE. This criterion is depicted at 1010, where $N_{pts}$ represents the number of temperature map cells (points) satisfying the search, and $N_{min}$ represents a preset minimum number of temperature map cells. This minimum number of cells is determined by a constant that is system dependent, and may be set at five cells in some embodiments. Second, the observation associated with the temperature tuple ($T_{ei}$,$T_{ci}$) for the observation must lie within the convex hull formed by the set of the observed tuples above. This criterion is depicted at 1012, and basically means that the temperature tuple at issue is "surrounded" by the observed cells (points) as described above. This allows the agent to perform a local interpolation between those tuples that have been observed rather than extrapolating outside the observed tuples, which can lead to an imprecise prediction. Determining whether a point lies within the convex hull of a set of points is a common problem in the field of linear programming and there are numerous "packaged" solutions that can be used to make that determination. As an example, the packaged function "linprog" included in the Python scipy.optimize library can be used in the determination, and there are many other packaged functions in Python and other programming languages capable of making the determination. This determination can greatly improve the reliability of degradation detection compared with prior art solutions.

If either of the criteria at 1010 and 1012 are violated, then the agent makes no prediction of the compressor input power parameter. In some implementations, the agent enters a value of "null" for the normalized residual sequence $R_d(n)$ in 1016 and simply returns to 1002 to receive a new observation. If both of the criteria at 1010 and 1012 are satisfied, then at 1014, the agent extracts the summary data from each cell in the set of cells found in the search above, computes the mean power parameter value of each cell, and computes the expected power parameter value $\hat{P}$ using a constrained optimization approach. In some embodiments this constrained optimization approach involves determining temperature sensitivity constants $K_{c0}$, $K_{cei}$, and $K_{cci}$ of a plane in 3 dimensions according to Equation (18):

$$\hat{P}(T_{ei},T_{ci})=K_{c0}+K_{cei}T_{ei}+K_{cci}T_{ci} \tag{18}$$

that minimizes the sum-squared error between the value computed by substituting the temperature tuple of each cell discovered in the neighborhood and the corresponding mean power parameter value of the corresponding cell computed using Equation (8), and where $K_{cei}$ and $K_{cci}$ are constrained to be greater than or equal to zero. The constraint reflects that an increase in either evaporator or condenser intake temperature should cause the refrigerant pressure in the system to increase in the evaporator or condenser, respectively, thus requiring more compressor power to move the refrigerant through the system. Hence both $K_{cei}$ and $K_{cci}$ should be non-negative. The above computation may be performed using the Python programming routine "scipy.optimize.lsq_linear" in some embodiments. Of course, other forms of modelling the power parameter as a function of $T_{ei}$ and $T_{ci}$ are possible, including higher order polynomial forms, but the form of Equation (18) is simple to understand, relatively fast to compute and accurate enough for the purposes discussed herein. Once the plane is established, the agent evaluates the plane at the tuple ($T_{ei}$, $T_{ci}$) of the observation to compute the predicted value of power parameter for the steady state observation of discourse. From there, the agent computes the normalized residual of the observation, $R_d(n)$ in 1018 and returns to 1002 to await another steady state observation.

Figure 11:
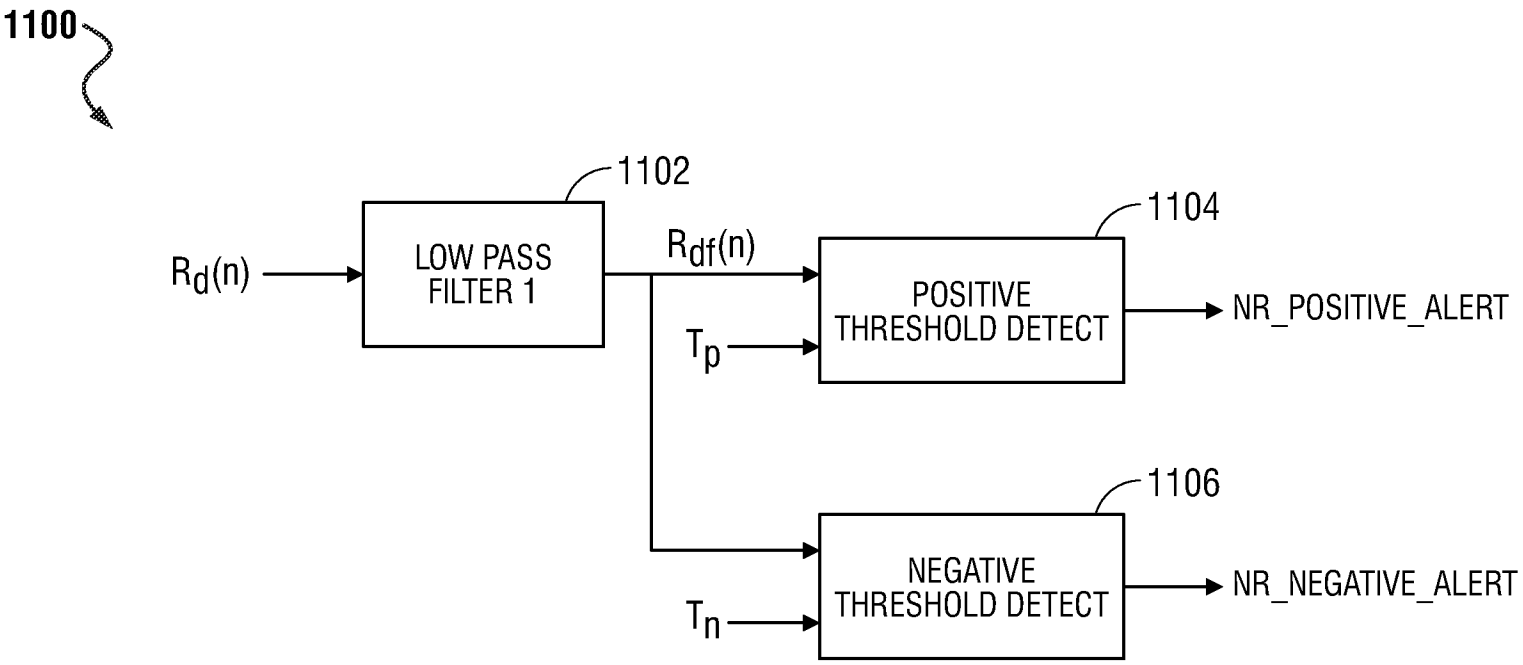
FIG. 11 illustrates a functional block diagram for detecting degradation according to aspects of the disclosed embodiments.

From the predictions, the degradation residual sequence generator creates a sequence of normalized residual, $R_d(n)$, referred to as a degradation residual sequence for each steady state observation according to the teachings of FIG. 10. This sequence of normalized residuals serves as an input to a degradation detection processor 514 by which the agent analyzes the degradation detection sequence. The purpose of the degradation detection processor is to monitor the sequence of normalized residuals and issue alerts and warnings as needed when it detects potential problems via the degradation residual sequence $R_d(n)$. A degradation detection processor can take many forms. FIG. 11 shows an exemplary block diagram description of degradation detection illustrative of the use of the degradation sequence $R_d(n)$ for purposes of indicating that degradation is likely in a system.

Referring to FIG. 11, the non-null elements of sequence $R_d(n)$ can serve as the input to a low-pass digital filter 1102 of which an EWMA type filter such as that described by Equations (12) and (13) is illustrative. In some implementations, a value of β of 0.9996 has been employed as the filter constant. The output of this filter 1102, is a sequence labeled $R_{df}(n)$ in FIG. 11. For those elements of $R_d(n)$ labeled NULL by the degradation detection processor 514, the agent can optionally insert a similar NULL value in the output sequence $R_{df}(n)$ in order to maintain synchronization between the input and output sequences of the filter.

The output of the low pass filter 1102 provides the input to two threshold detectors, a positive threshold detector 1104 and a negative threshold detector 1106. The positive threshold detector 1104 can compare the non-null sequence elements of the filtered $R_{df}(n)$ sequence against a preset threshold value $T_p$ and declare a logical variable NR_Positive_Alert to have the Boolean value TRUE when the value of an element $R_{df}(n)$ exceeds the positive threshold $T_p$, and FALSE when it does not. In some implementations a value of 0.05 is used as the positive threshold. The logical value NR_Positive_Alert can be used to trigger an alarm condition when TRUE, indicating that the power parameter values of steady state observations is consistently greater than about 0.05 or 5%, an indication that the HVAC&R system is using excessive power for the conditions of operation and, as was discussed above, is often indicative of something wrong in the condenser subsystem.

Similarly, the filtered degradation residual sequence, $R_{df}(n)$ can be applied to negative threshold detector 1106 which produces as an output a logic NR_Negative_Alert which is assigned a TRUE value when $R_{df}(n)$ is less than a negative threshold value $T_n$ and FALSE when it is not. In some implementations a value of −0.05 is used for $T_n$. A TRUE value of the output NR_Negative_Alert under these conditions indicates that the power parameter values of recent steady state observations is consistently less than that of a newly maintained system by 0.05 or 5%. A discussed previously, this can indicate the need for service and is often indicative of something wrong in the evaporator subsystem or a loss of refrigerant.

The above are exemplary uses of a degradation detection processor to detect system problems from the degradation residual sequence. A degradation detection processor can perform other processing of the degradation residual sequence including, for instance, trend analysis in which the degradation detection processor predicts the date and time at which the degradation residual sequence will, on average, exceed a threshold value. This can be valuable in scheduling service before the HVAC&R system degrades to a point where its performance is compromised beyond simple excessive energy consumption.

The degradation detection processor 514 can present the results of analysis such as the exemplary analysis shown in multiple ways to inform a system owner or service bureau of the need for maintenance in ways well understood in the art. For instance, a warning signal and or audio/visual alert can be generated directly by the degradation detection processor or the fact of an alert can be communicated via a newsfeed that may include a text message or email to a designated person.

VCC based systems that are more complex than the basic HVAC&R system discussed thus far may also benefit from the principles and teachings herein. Many commercial and industrial HVAC&R systems, for example, have multiple compressors rather than a single compressor. The multiple compressors are housed within a single mechanical package and operate in parallel to adjust the heat load conditions.

Figure 12:
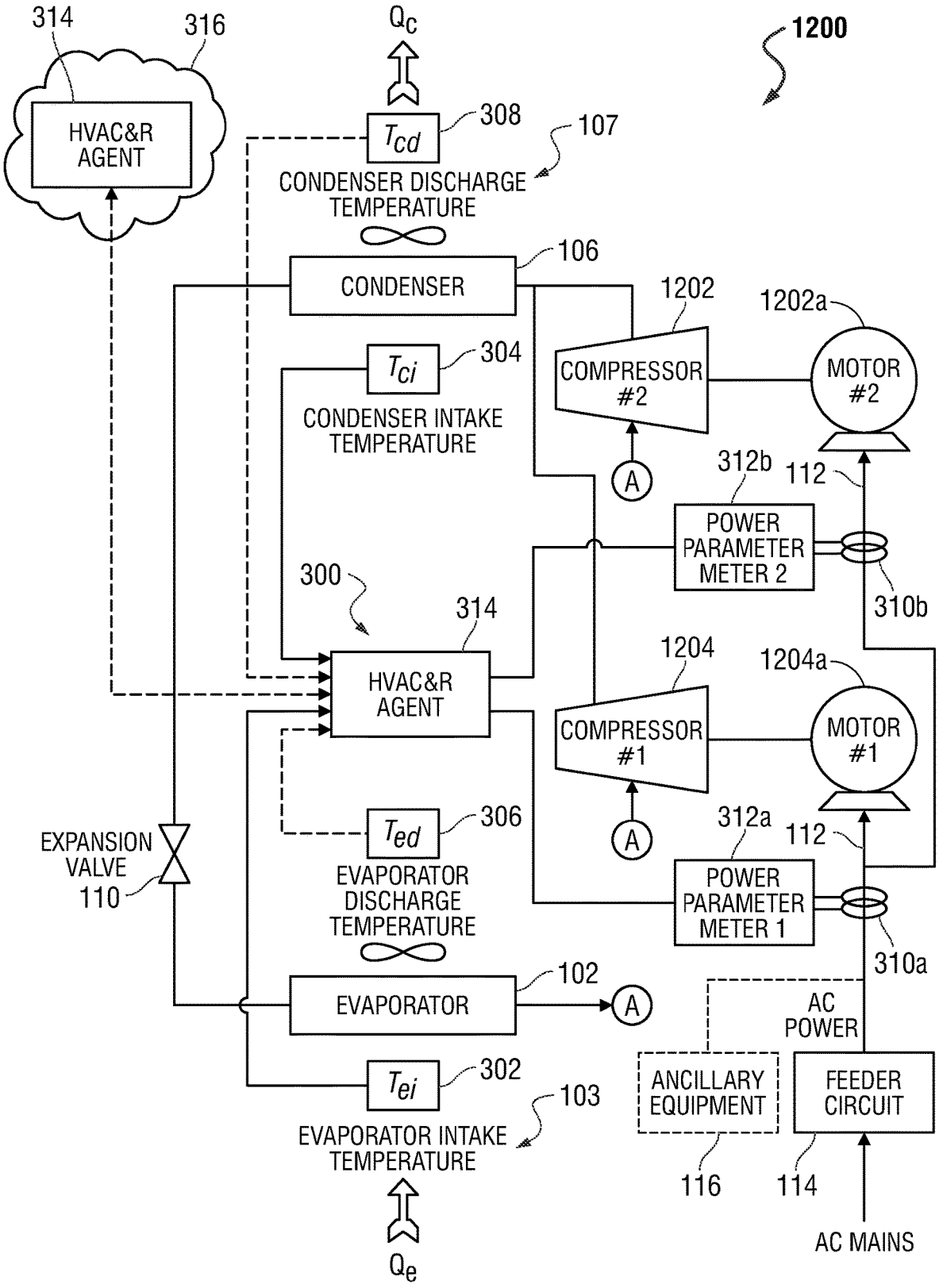
FIG. 12 illustrates an HVAC&R system having multiple compressors equipped with a monitoring agent according to aspects of the disclosed embodiments.

FIG. 12 shows an example of a HVAC&R system 1200 having multiple compressors that is equipped with the early problem detection system 300 discussed herein. The early problem detection system 300 otherwise operates in a similar manner to that described above with respect to the HVAC&R system 100 of FIG. 1 using similar components, except that instead of a single compressor, the early problem detection system 300 predicts the compressor input power parameter for two compressors 1202 and 1204. As can be seen, each compressor 1202, 1204 is being driven by a corresponding motor 1202*a* and 1204*a*, with the input power for each motor 1202*a*, 1204*a* being measured by a respective current detection device 310*a* and 310*b* and power parameter meter 312*a* and 312*b*. In such an arrangement, it has been observed that the power consumed by each motor 1202*a*, 1204*a* individually when both motors are running is lower compared to the power consumed by either motor running alone. The input power measurements from each power parameter meter 312*a*, 312*b* are then provided to the agent 314, which processes the measurements to derive the CIPP relation for each compressor 1202, 1204 using a separate temperature map for each compressor, respectively.

In still other HVAC&R systems, multiple refrigerant loops may exist, each refrigerant loop supported by one or more compressors. In many of these systems, each refrigerant loop has its own condenser coil (and fan assembly in the case of a direct exchange), and the condenser coils may be physically separated in space in such a manner that they may experience significantly different intake temperatures. This is often the case, for example, with rooftop units in which for certain parts of the day, one condenser coil and the rooftop nearby is directly in the sun whereas the other side is shaded. For this reason, there may be more than one condenser intake temperature sensor. Many of these multi-refrigerant-loop systems share an interleaved evaporator coil in which the refrigerant of the individual loops is maintained separate from one another, but all of the loops are cooling the same fluid flowing across the interleaved evaporator. In this case a single evaporator intake temperature sensor may be employed even though there are multiple condenser intake temperature sensors.

In some chilled water systems, each refrigerant loop has its own condenser coil, likely physically separated in space, and its own evaporator coil. In these systems, each refrigerant loop chills its own fluid and the fluids are mixed upstream. In this type of system, there may be more than one evaporator intake temperature sensor. From a practical design perspective, it is preferable to structure the system so that each compressor is permitted to have its own virtual condenser and evaporator intake temperature sensor.

Consider the case of an interleaved evaporator coil in a direct exchange system. For a given intake airflow temperature and rate (mass flow rate) across the evaporator function, the power required of one compressor in a multi-compressor system will be dependent upon the states of the other compressors. So if two compressors are employed to cool the air, it is expected that the power consumed by either compressor operating in tandem will be less than that of the same system under the same conditions if only a single compressor is running. The important point from a CIPP perspective is that the operating characteristics of a given compressor in a system may be dependent upon the state of the other compressors in the system. Accordingly, a CIPP relation is preferably maintained for every compressor for each combination of compressors for which said compressor is operational.

It should be noted that in the foregoing embodiments, the agent has little control over the condenser intake temperatures, as the intake temperatures can be dependent upon many factors, including the weather, the time of day, the orientation of the condenser, and so forth. In operation, the agent is simply presented with the intake temperatures as observations of the HVAC&R system to be monitored, each observation comprising a minimum of one or more condenser intake temperature $T_{ci}$, one or evaporator intake temperature $T_{ei}$, and a compressor input power parameter P for each compressor in the system. The compressor input power parameter P may be compressor current, real power, volt-amperes, and the like.

As a matter of learned or commissioned configuration, to each compressor is assigned an appropriate condenser intake temperature measurement, or a combination of compressor intake temperature measurements, an evaporator intake temperature measurement or a combination of evaporator intake temperature measurements, and the measured power parameter for that compressor. In some systems, a single condenser intake temperature may suffice for all compressors, but in some systems it can be advantageous to have different condenser intake values, particularly when there is more than one condenser that may be oriented differently from one another. Similarly, in chiller systems, each chiller compressor unit has its own evaporator function and it can be advantageous to assign a separate temperature to each intake. In other systems, an interleaved evaporator assembly can be employed, in which case a single temperature measurement can be sufficient for all compressors in all refrigerant loops that incorporate the interleaved evaporator.

In some systems, multiple compressors may be employed in an single refrigerant loop, while in other systems incorporating interleaving or condenser and evaporator units in close proximity to one another, the characteristic learned by the agent for a given compressor may be a function of the "compressor state" of the system (i.e., which compressors are on or off at a given time). Because of this potential for interaction, the agent maintains a learned model of behavior for each given compressor in the system for each compressor state in which the given compressor is operational or in the on state.

Also, the fluids at the intakes referred to above need not be air. Water or a chemical mix (such as ethylene glycol and water or a saline solution) can serve as the evaporator ambient fluid or the condenser ambient fluid. In a so-called chilled water system, the liquid evaporator ambient fluid is circulated as a liquid through the system. This chilled liquid fluid can be circulated through a building to different radiators where it can be used to cool remotely. This can be useful for cooling large areas, such as schools, hospitals and commercial buildings, as well as more commonplace spaces, such as supermarket refrigerators and freezers where the chemical mix can be cooled to well below the freezing point of water. The condenser ambient can likewise be a liquid. This can be useful in large chilled water systems where the condenser fluid can be circulated over the condenser coil of a system located inside a building and the heat transferred to a heat exchanger located outdoors. Such a system can have an advantage over direct exchange systems insofar as not requiring long runs of refrigerant lines operating under high pressure to and from an outdoor heat exchanger. A very common chilled water system called an air-cooled chiller uses direct exchange of heat through the air as the condenser ambient, while cooling a liquid as the evaporator ambient fluid. This allows the entire mechanical system including the compressor(s) and condenser fans to be located outdoors or in an out-building.

In a heat pump system operating in the heating mode, a reversing valve reverses the roles of the condenser and evaporator as described in FIG. 1, with the condenser function located within the conditioned space and the evaporator function pulling heat from the outdoor ambient. The physical heat exchangers do not move, but their roles are reversed. The evaporator function (now outside) absorbs heat from the outdoor ambient air and rejects this heat into the air of the conditioned space via the condenser function (now inside). In this case, it is normal for frost to condense onto the evaporator coil function (outside) which must be defrosted occasionally as part of normal operation.

The extension of the disclosed monitoring and early problem detection system to more complex HVAC&R systems thus provides many benefits. It should be noted, however, that when multiple compressors are employed in an individual package and interleaved evaporators are incorporated into a system, a separate temperature map is employed for each compressor in each individual compressor "state" of the system. For example, in a three-compressor system in which a total of 8 individual combinations of compressor on/off states are possible, a total of 12 temperature maps are required to predict the newly maintained characteristics of the system. And the discussion herein regarding when an observation can represent the "steady state" of the vapor compression cycle applies not just when the particular compressor at issue turns on or off, but when any compressor in the system changes state.

While having a direct, isolated measurement of a compressor power parameter can yield the most accurate predictions of that compressor power parameter as described herein, and the method and has been described in these terms, a signal simply responsive to a compressor power parameter can similarly provide useful information and systems so-instrumented can be valuable in detecting HVAC&R system degradation. In particular, in many HVAC&R systems, it is simpler to monitor a power parameter of the power feed to the entire unit or partial unit instead of direct measurement of the compressor. Many, if not most, HVAC&R units are driven by isolated branch feeders circuits that may have current or power measurement capability built in to the circuit breakers and many residential split-systems, packaged units and commercial roof-top units have a disconnect located physically near the unit to allow an HVAC&R technician to electrically isolate the unit for the purpose of service. The power feed to the entire unit often includes the power provided to condenser fans, and multiple compressors, which add to the power consumed by the compressor.

The entire or partial unit power feed embodiment above is shown as an alternative implementation in FIG. 5 via dashed lines. As shown in FIG. 5, in some embodiments, instead of (or in addition to) a power parameter meter such as the power parameter meter 312, the input to the power parameter processor 504 can be provided by an energy meter embedded in the branch feeder circuit 114 or included with an electrical disconnect box or other ancillary equipment 116. The energy meter may be a discrete meter that forms part of the branch feeder circuit 114, or it may be integrated in the feeder circuit 114, for example, in a circuit breaker of the feeder circuit 114. In either case, the power measured by the energy meter reflects the entire or partial unit power input to the HVAC&R system 100. This feeder circuit power input may then be provided to the power parameter processor 504 of the agent for detecting HVAC&R system degradation in a similar manner to that described for the power parameter meter 312.

Those having ordinary skill in the art will appreciate that other implementations are available within the scope of the present disclosure. From a practical consideration, a desirable characteristic of a learning system to monitor HVAC&R systems for problems that are developing is to quickly become functional and not require a long training interval over which time the equipment is not monitored for degradation. That is, to the extent practical, the agent should learn the time invariant CIPP relation on-the-fly.

Figure 13A:
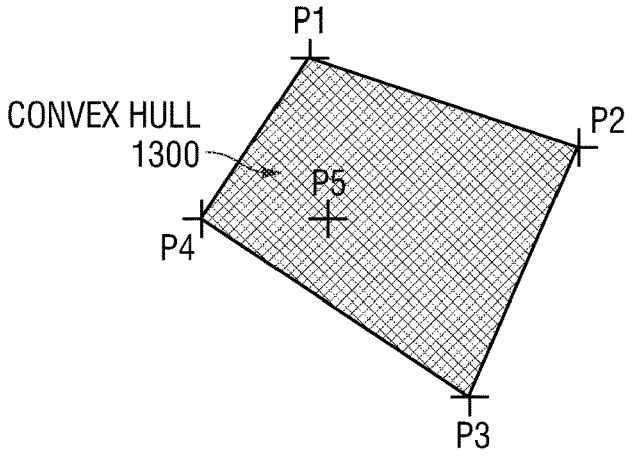
FIG. 13A-13C illustrates exemplary convex hulls for determining whether to present a CIPP prediction according to aspects of the disclosed embodiments.
Figure 13B:
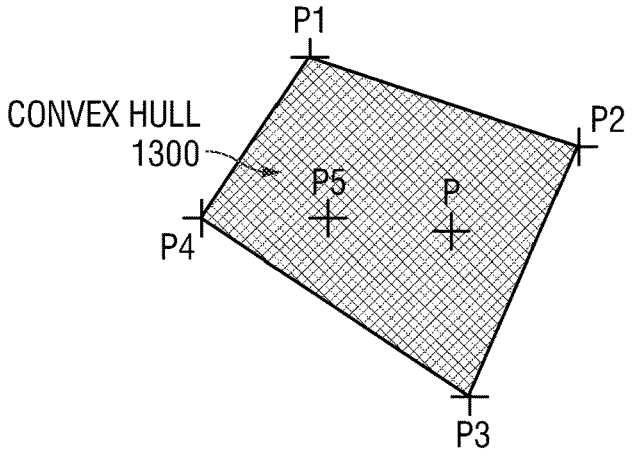
Figure 13C:
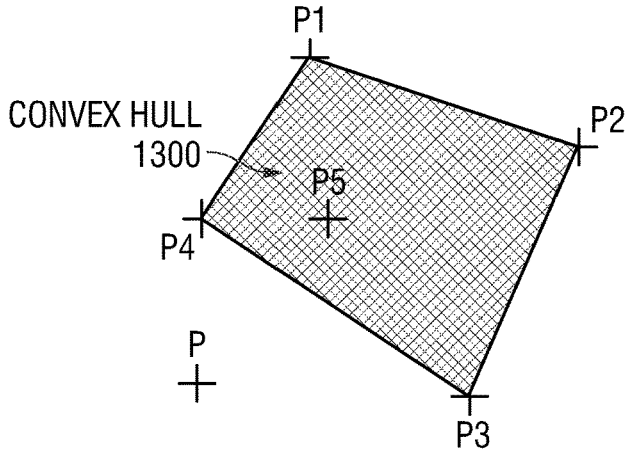

Turning now to FIGS. 13A-13C, recall from above that in some embodiments the agent generates a prediction only if the temperature tuple ($T_{ei}$,$T_{ci}$) for the observation of interest lies within a convex hull of the set of observed tuples. In these embodiments, a newly observed temperature tuple must lie within a convex hull formed of previously observed tuples (points) that were in the original set used by the agent to learn the CIPP relation. This ensures that the agent is interpolating between tuples (points) that were already "seen" by the agent rather than extrapolating from unseen points. In some embodiments, the convex hull can be defined as follows. Given a set of training points {X} in a Euclidean space, the convex hull H(X) of the set {X} is the smallest set containing the points in {X} for which every point on any line between any two points in H(X) lies entirely within H(X).

FIGS. 13A-13C graphically illustrate examples of hull convexity in accordance with some embodiments. Referring first to FIG. 13A, an exemplary convex hull 1300 is created by a set {X} that contains five 2-dimensional tuples, labeled P1 to P5, respectively. The line segments P1→P2, P2→P3, P3→P4 and P4→P1 form the edges of the convex hull 1300 defined by the set {X}. In this example, the tuples P1 to P5 defining the edges of the convex hull 1300 are included in the convex hull. The hull is "convex" in that any line segment in the hull, including those line segments formed by tuples on the edges of the hull, lies completely within the hull. The tuple P5 also lies within the hull. It can be seen visually that the convex hull 1300 is the smallest set of tuples that contains all the tuples in the set {X}, and is convex.

FIG. 13B shows an example of a tuple P that lies within the convex hull 1300. If an interpolated model made from the set of tuples {P1 . . . P5} is applied to the tuple P, the model is interpolating between the values of the tuples within the set.

FIG. 13C shows an example of a tuple P that lies outside the convex hull 1300. In this example, a line drawn between P and, say P5, contains points that lie within the convex hull 1300 as well as points that lie outside the convex hull. If an interpolated model made from the set {P1 . . . P5} is applied to the tuple P, the model is extrapolating from the values of the tuples within the set. The accuracy of extrapolation, in general, is generally less precise than interpolation. Accordingly, the agent requires that any tuple for which a predicted compressor input power parameter value is to be determined needs to lie within the convex hull of observed tuples.

Figure 14:
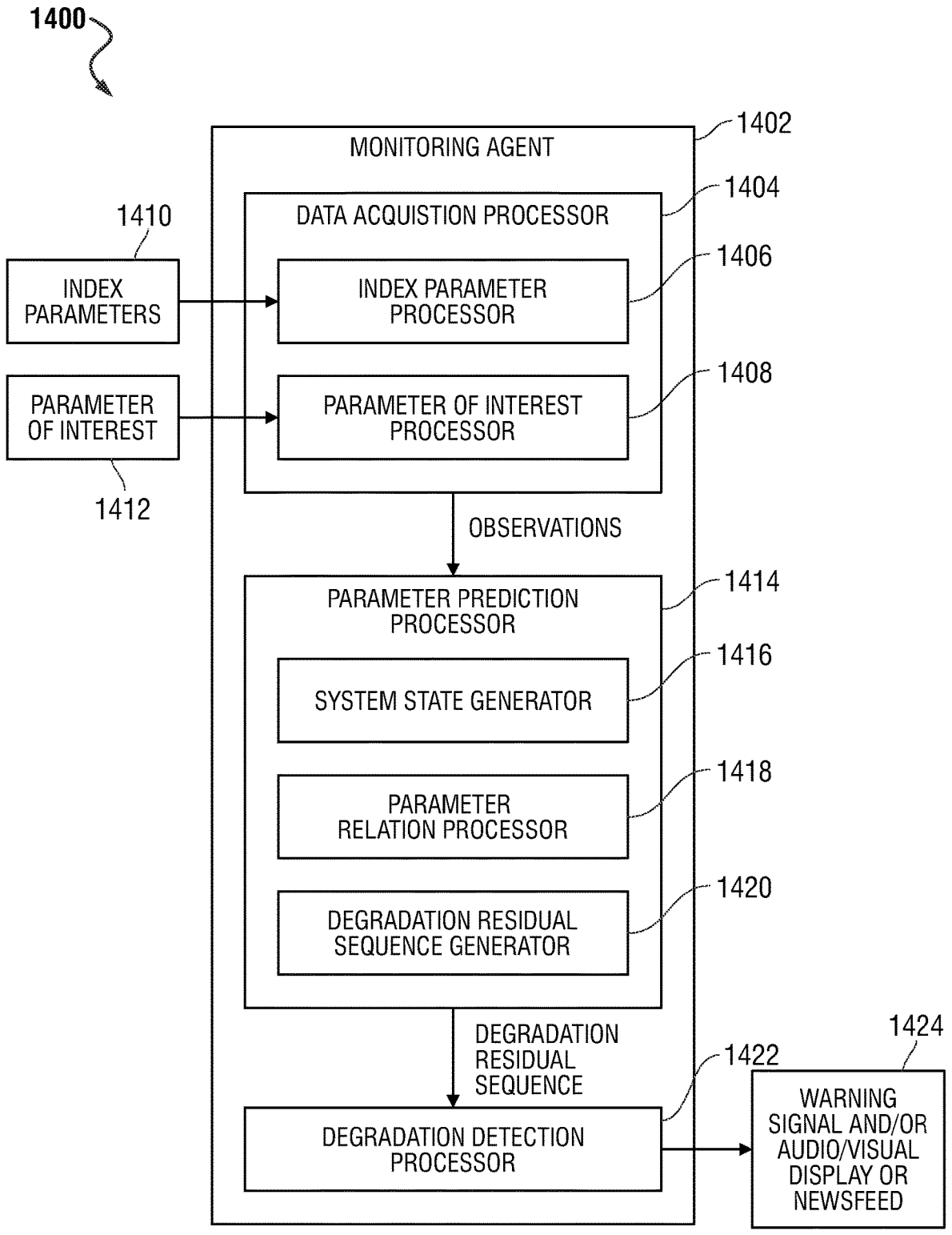
FIG. 14 illustrates an exemplary implementation of a system parameter monitoring agent according to aspects of the disclosed embodiments.

Referring next to FIG. 14, a more general system parameter monitoring agent 1402 is shown that may be used with other types of systems, indicated at 1400, in addition to the HVAC&R systems described herein. As mentioned at the outset, the principles and teachings discussed herein are applicable to any deterministic system or equipment in which a certain parametric outcome or value will consistently result for a given parameter of interest, and thus can be quickly learned and predicted as described herein, given an index parameter or set of index parameters (and the values thereof). Examples of parameters that may be used as the parameter of interest and the index parameters include flow control parameters (e.g., flow rate, viscosity, etc.), power control parameters (e.g., voltage, current, etc.), motion control parameters (e.g., speed, height, etc.) and the like, as well as combinations thereof.

From FIG. 14, it can be seen that the agent 1402 has similar functional components to the agents discussed earlier, including a data acquisition processor 1404, a parameter prediction processor 1414, and a degradation detection processor 1422 (and their respective sub-components). The data acquisition processor 1404 operates to continuously acquire and store observations for the parameters that will be used as the index parameters, indicated at 1410, and the parameter of interest, indicated at 1412. These observations 1410, 1412 may be acquired in real time using appropriate sensors that measure such parameters, or they may be obtained from a database of such observations, or combination of both. Based on these observations 1410, 1412, the data acquisition processor 1404 assembles time sequences of observations that can be used by the parameter prediction processor 1414. The parameter prediction processor 1414 operates to derive certain operational information from the time sequence of observations and selectively uses the observations to learn a relation between the index parameters 1410 and the parameter of interest 1412. Thereafter, the parameter prediction processor 1414 uses the learned relation along with the observations to generate a time sequence of normalized residuals that contain information regarding the physical condition of the system 1400. This sequence of normalized residuals is passed to the degradation detection processor 1422, which interprets the time sequence of normalized residuals, and can issue warning signals or audio visual displays or sends information via newsfeeds 516 indicating potential problems with the system 1400.

Table 4 below shows an exemplary observation that may be provided by the data acquisition processor 1404 to the parameter prediction processor 1414. In the table, the exemplary observation contains several parameters that may be used as indices 1410, including index parameter 1, index parameter 2, and so forth, up to index parameter i, for the parameter of interest 1412. Consider an example in the HVAC&R context where the compressor input power is a function of the condenser intake temperature, the evaporator intake temperature, and the evaporator discharge temperature. Such an HVAC&R system would have a temperature map with three index parameters, i.e., the three temperatures mentioned, instead of the two index parameters discussed above. These index parameters and parameters of interest, or rather the values therefor, may be obtained from appropriate sensors that are strategically positioned to measure such values. Alternatively, a proxy may be used for one or more of these parameters rather than directly measuring the these parameters. An optional time stamp or tag indicating the date and time instant or interval represented by the measured parameters may be included in the observation in some implementations.

TABLE 4

| Exemplary Observation | | | | | |
|---|---|---|---|---|---|
| Time Stamp (optional) | Index Param 1 | Index Param 2 | . . . | Index Param i | Parameter of Interest |
| Date/Time represented by observation | Sensor Reading(s) | Sensor Reading(s) | . . . | Sensor Reading(s) | Sensor Reading(s) |

The time sequence of observations are forwarded from the data acquisition processor 1404 to the parameter prediction processor 1414 either one at a time or in a batch data frame as described above. In accordance with the disclosed embodiments, the parameter prediction processor 1414 is operable to derive or learn a relation between the index parameters and the parameter of interest and use the relation to monitor the system 1400 for performance degradation from the observations provided by data acquisition processor 1404. In some embodiments, the parameter prediction processor 1414 includes a system state generator 1416 that operates to derive certain timing information from the sequence of observations provided by the data acquisition processor 1404 and augment the observations with this information, resulting in a sequence of steady state observations. A parameter relation processor 1418 is provided to learn the relation from the augmented time sequence of steady state observations provided by the system state generator 1416.

Also included is a degradation residual sequence generator 1420, which uses the learned relation and the time sequence of steady state observations to compute a time sequence of normalized residuals, labeled degradation residual sequence, that is indicative of the condition of the system 1400. It will be appreciated that the version of the degradation residual sequence generator discussed above with respect to HVAC&R systems (see FIG. 5) is but one embodiment. That embodiment assumes that if a time-varying reference residual function of the form Rsys(Tci, Tei) can be determined, and a means for keeping Rsys up to date can be provided, then given an observation at a temperature tuple (Tci, Tei), a prediction of the compensated value of the input power parameter can be made using Equation (13). However, the degradation residual sequence generator 1420 is not limited to that embodiment alone. In general, the degradation residual sequence generator 1420, or the underlying principles and teachings thereof, can be used with any system 1400 where there is a fixed, known, or learnable "form" of relation between a residual and a set of index parameters.

The degradation residual sequence produced by the degradation residual sequence generator 1420 can then be provided to the degradation detection processor 1422. The degradation detection processor 1422 thereafter operates to analyze the degradation residual sequence produced by the degradation residual sequence generator 1420 to detect and report degradation.

As discussed, predictions of the parameter of interest using the embodiments described herein are most accurate after the system has been operational a long enough time that the system has stabilized with respect to the parameter of interest, which time can vary depending on the equipment. To this end, the system state generator 1416 can detect, using appropriate logic or circuitry, whether the system has stabilized with respect to the parameter of interest and is in a steady state and thus likely stable, or in a transient state and likely unstable. The system state generator can then declare whether the system is stable or not stable for purposes of the relation. In some embodiments, the system state generator 1416 can augment an observation obtained from data acquisition processor 1404 with system state information in the form of Boolean variables. The Boolean variables may take the values in the set {TRUE, FALSE} to represent the system state. The VCC state generator 508 can set the Boolean variables to TRUE to indicate that the system is stable and in an On state, respectively per above, and FALSE to indicate otherwise. In some implementations, the agent 1402 may associate system state information such as that referenced above with each observation, resulting in an augmented observation.

The parameter relation processor 1418 is responsible for learning the relation between the values of the index parameters 1410 and the parameter of interest 1412 from the steady state observations described above. This parameter relation processor 1418 includes three main functions that provide capabilities desirable for building a relation that represents the system 1400 in newly maintained condition. In some embodiments, the parameter relation processor 1418 compiles and maintains a parameter map similar to the temperature map discussed above that relates the index parameters 1410 to the parameter of interest 1412. In some embodiments, a bootstrap learning strategy may be used similar to that discussed herein, combined with a reference degradation estimator function to modify in some cases the parameter of interest values of steady state observations prior to using the modified observations to populate the parameter map.

In some implementations, the agent 1402 builds the parameter map using the steady state observations provided by the system state generator 1416, each steady state observation including at least an index parameter or a set of index parameters and a corresponding parameter of interest. Each index parameter or set of index parameters forms an index into the parameter map for the parameter of interest, and the agent 1402 "learns" by updating summary data for the cell from parameter of interest values of steady state observations corresponding to the index parameter values. The agent 1402 updates the summary data for a given cell in this manner until a sufficient number of observations have been applied, as described above. At that point, the agent stops updating the summary data for that cell and the summary data of the cell can be used to make predictions of the parameter of interest value representing the system in newly maintained condition. Parameter value predictions in some cases may derive directly from the summary data of an individual cell indexed by a set of a steady state observations for the index parameters once the requisite number of observations have been made for that cell. In other cases, the agent may derive a power parameter prediction for a set of a steady state observations for the index parameters by performing local regression using summary data from nearby value, as described herein.

With the above approach, the agent can gather data quickly and begin making parameter value predictions almost immediately, provided the system is running and is in newly maintained state. Using the parameter map described herein, the agent can assess whether a prediction of the parameter values corresponding to a given index parameter or set of index parameters is likely to represent the characteristics of a system in newly maintained condition and decide whether or not to issue the prediction. The ability to assess the reliability of a prediction beneficially reduces the possibility of the agent issuing false positives and false negatives. Additionally, because the relation can be assumed to be quasi-independent on the index parameters in some systems, the agent can continue to learn the characteristics of the system in newly maintained condition while the system is degrading, thereby compensating for the degradation so the predictions better represent the system in newly maintained condition.

Further, continued learning of the relation by the agent can be achieved by updating the parameter map as additional observations of the index parameters and corresponding parameter of interest data becomes available. And as discussed, in some embodiments, the parameter map may be updated in batches, whereby a group of observations are assembled into one or more data frames of steady state observations and presented to the parameter prediction processor 1414 of the agent by the data acquisition processor 1404 as a batch of observations. It is of course also possible in some embodiments to provide the observations on an individual observation basis, one at a time as they are received.

A partial example of an exemplary parameter map is shown in Table 5 below, where the cells of the map contain summary values for the parameter of interest observed for each temperature parameter index. Although the table is shown as being mostly filled, in general, only those cells for which the values of $T_{ei}$ and $T_{ci}$ have been observed will contain summary values.

TABLE 5

| Exemplary Parameter map | | | | | | |
|---|---|---|---|---|---|---|
| | | Index Param 1 | | | | |
| | | IV0 | IV1 | IV2 | . . . | X |
| Index Param 2 | IV0 | C00 | C10 | C20 | . . . | CX0 |
| | IV1 | C01 | C11 | C21 | . . . | CX1 |
| | IV2 | C02 | C12 | C22 | . . . | CX2 |
| | . . . | . . . | . . . | . . . | . . . | . . . |
| | Y | C0Y | C1Y | C2Y | . . . | CXY |

As discussed earlier, each cell (e.g., C00, C01, C02, etc.) in the parameter map contains summary values for the observations corresponding to the index values (e.g., IV0, IV1, IV2, etc.) that serves as an index into the cell. These summary values or summary statistics (or sample statistics) provide summary information about the steady state observations represented by the cell. As examples, the summary values may provide information about the data in the data set, such as the sum total, the mean, the median, the average, the variance, the deviation, the distribution, and so forth. The agent may then use these summary values to generate predictions of the parameter of interest as discussed above.

The predictions are then provided to the degradation residual sequence generator 1420 of the agent to create a degradation residual sequence for each steady state observation. This sequence of degradation residual serves as an input to the degradation detection processor 1422 that is configured to analyze the degradation detection sequence in the manner similar to that discussed above. The degradation detection processor 1422 monitors the sequence of degradation residuals and issues a warning signal and/or an audio/visual display or newsfeed, generally indicated at 1424, in response to detection of potential problems via the degradation residual sequence.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the scope of the invention as defined in the appended claims.

What is claimed is:

1. A heating, ventilating, and air conditioning and refrigeration (HVAC&R) system, comprising:

an HVAC&R controller;

condenser intake and discharge sensors communicatively coupled to the HVAC&R controller, the condenser intake and discharge sensors operable to provide condenser fluid temperature measurements to the HVAC&R controller;

evaporator intake and discharge sensors communicatively coupled to the HVAC&R controller, the evaporator intake and discharge sensors operable to provide evaporator fluid temperature measurements to the HVAC&R controller; and one or more compressor power parameter meters communicatively coupled to the HVAC&R controller, the one or more one or more compressor power parameter meters operable to provide compressor input power parameter measurements corresponding to the fluid temperature measurements;

wherein the HVAC&R controller is operable to:

store the compressor input power parameter measurements via a temperature map containing a plurality of cells, each cell storing the compressor input power parameter measurements corresponding to that cell as summary statistics, each cell indexed using a condenser evaporator fluid temperature measurement and an evaporator fluid temperature measurement corresponding to that cell;

learn a relation between the fluid temperature measurements and the compressor input power parameter measurements using the temperature map;

compute a predicted value for a compressor input power parameter using the relation;

compare the predicted value for the compressor input power parameter against an observed compressor input power parameter measurement;

determine whether performance degradation has occurred in the HVAC&R system based on comparing the predicted value for the compressor input power parameter against the observed compressor input power parameter measurement; and issue an alert or alarm to a user upon determining that performance degradation has occurred in the HVAC&R system.

2. The system of claim 1, wherein for a given cell, the HVAC&R controller stops processing compressor input power parameter measurements corresponding to that cell for purposes of storage in the cell after a predefined maximum number of compressor input power parameter measurements has been stored for that cell.

3. The system of claim 1, wherein the HVAC&R controller learns the relation between the fluid temperature measurements and the compressor input power parameter measurements using only compressor input power parameter measurements that were provided during steady-state operation of the HVAC&R system.

4. The system of claim 1, wherein the HVAC&R controller learns the relation between the fluid temperature measurements and the compressor input power parameter measurements using only compressor input power parameter measurements that were provided when the HVAC&R system is in newly-maintained condition.

5. The system of claim 1, wherein in response to performance degradation being detected in the HVAC&R system, the HVAC&R controller adjusts the compressor input power parameter measurements to compensate for the performance degradation such that the compressor input power parameter measurements reflect the HVAC&R system in newly-maintained condition.

6. The system of claim 1, wherein for a given compressor input power parameter measurement, the HVAC&R controller computes the predicted value for the compressor input power parameter if the fluid temperature measurements corresponding to the given compressor input power parameter measurement lie within a convex hull of the set of fluid temperature measurements provided to the HVAC&R controller.

7. The system of claim 1, wherein for a given compressor input power parameter measurement, the HVAC&R controller does not compute the predicted value for the compressor input power parameter if the fluid temperature measurements corresponding to the given compressor input power parameter measurement do not lie within a convex hull of the set of fluid temperature measurements provided to the HVAC&R controller.

8. The system of claim 1, wherein for a given compressor input power parameter measurement, the HVAC&R controller computes the predicted value for the compressor input power parameter if a minimum number of fluid temperature measurements have been previously provided corresponding to that compressor input power parameter measurement.

9. The system of claim 1, wherein the HVAC&R controller is configured to compute a predicted value for a compressor input power parameter using the relation after a preselected minimum number of fluid temperature measurements and compressor input power parameter measurements are used to learn the relation.

10. The system of claim 1, wherein the HVAC&R controller is implemented on one or more of the following: a cloud-based network, a fog-based network, and locally to the HVAC&R system.

11. A method of operating a heating, ventilating, and air conditioning and refrigeration (HVAC&R) system, comprising:

providing condenser fluid temperature measurements to an HVAC&R controller, the condenser fluid temperature measurements obtained by condenser intake and discharge sensors communicatively coupled to the HVAC&R controller;

providing evaporator fluid temperature measurements to the HVAC&R controller, the evaporator fluid temperature measurements provided by evaporator intake and discharge sensors communicatively coupled to the HVAC&R controller;

providing compressor input power parameter measurements to the HVAC&R controller, the compressor input power parameter measurements provided by one or more compressor power parameter meters communicatively coupled to the HVAC&R controller;

storing the compressor input power parameter measurements via a temperature map containing a plurality of cells, each cell storing the compressor input power parameter measurements corresponding to that cell as summary statistics, each cell indexed using a condenser evaporator fluid temperature measurement and an evaporator fluid temperature measurement corresponding to that cell;

learning a relation between the fluid temperature measurements and the compressor input power parameter measurements using the temperature map;

computing a predicted value for a compressor input power parameter using the relation;

comparing the predicted value for the compressor input power parameter against an observed compressor input power parameter measurement;

determining whether performance degradation has occurred in the HVAC&R system based on comparing the predicted value for the compressor input power parameter against the observed compressor input power parameter measurement; and issuing an alert or alarm to a user upon determining that performance degradation has occurred in the HVAC&R system.

12. The method of claim 11, wherein for a given cell, the method further comprises stopping processing of the compressor input power parameter measurements corresponding to that cell for purposes of storage in the cell after a predefined maximum number of compressor input power parameter measurements has been stored for that cell.

13. The method of claim 11, wherein the relation is learned using only compressor input power parameter measurements that were provided during steady-state operation of the HVAC&R system.

14. The method of claim 11, wherein the relation is learned using only compressor input power parameter measurements that were provided when the HVAC&R system is in newly-maintained condition.

15. The method of claim 11, wherein in response to performance degradation being detected in the HVAC&R system, adjusting the compressor input power parameter measurements to compensate for the performance degradation such that the compressor input power parameter measurements reflect the HVAC&R system in newly-maintained condition.

16. The method of claim 11, wherein for a given compressor input power parameter measurement, the predicted value for the compressor input power parameter is computed if the fluid temperature measurements corresponding to the given compressor input power parameter measurement lie within a convex hull of the set of fluid temperature measurements provided.

17. The method of claim 11, wherein for a given compressor input power parameter measurement, the predicted value for the compressor input power parameter is computed if the fluid temperature measurements corresponding to the given compressor input power parameter measurement do not lie within a convex hull of the set of fluid temperature measurements provided.

18. The method of claim 11, wherein for a given compressor input power parameter measurement, the predicted value for the compressor input power parameter is computed if a minimum number of fluid temperature measurements have been previously provided corresponding to that compressor input power parameter measurement.

19. The method of claim 11, wherein the predicted value for a compressor input power parameter is computed using the relation after a preselected minimum number of fluid temperature measurements and compressor input power parameter measurements are used to learn the relation.

20. The method of claim 11, wherein the method is implemented on one or more of the following: a cloud-based network, a fog-based network, and locally to the HVAC&R system.

* * * * *